US005954551A

United States Patent [19]

King

[11] Patent Number: 5,954,551

[45] Date of Patent: *Sep. 21, 1999

[54] TROLLING MOTOR CONTROL APPARATUS

[76] Inventor: Terry King, 546 Johnson King Rd., Swansea, S.C. 29160

[ * ] Notice: This patent is subject to a terminal disclaimer.

[21] Appl. No.: 08/609,246

[22] Filed: Mar. 1, 1996

Related U.S. Application Data

[63] Continuation-in-part of application No. 08/381,778, Feb. 1, 1995, Pat. No. 5,496,198, which is a continuation-in-part of application No. 08/164,007, Dec. 8, 1993, abandoned.

[51] Int. Cl.[6] ..... B60L 11/02

[52] U.S. Cl. ..... 440/6; 440/7; 440/87

[58] Field of Search ..... 440/1, 6, 7, 62, 440/84, 85, 87; 114/144 R, 153, 363

[56] References Cited

U.S. PATENT DOCUMENTS

| | | | |
|---|---|---|---|
| 2,666,407 | 1/1954 | Wilkerson | 144/144 |
| 2,845,891 | 8/1958 | Frey | 114/144 |
| 3,039,420 | 6/1962 | Bevis et al. | 115/18 |
| 3,580,212 | 5/1971 | Fortson | 115/18 |
| 4,022,145 | 5/1977 | Tindal | 114/153 |
| 4,143,436 | 3/1979 | Jones | 9/7 |
| 4,195,588 | 4/1980 | Hudson | 115/18 |
| 4,515,567 | 5/1985 | Wilson | 440/7 |
| 4,527,983 | 7/1985 | Booth | 114/153 |
| 4,610,632 | 9/1986 | Osborne | 440/6 |
| 4,631,034 | 12/1986 | Jenne et al. | 440/7 |
| 4,645,462 | 2/1987 | Fulton | 440/6 |
| 4,722,706 | 2/1988 | Young | 114/153 |
| 4,728,307 | 3/1988 | Burgess | 114/153 |
| 4,891,024 | 1/1990 | Benjamin | 440/28 |
| 5,052,325 | 10/1991 | Rhines | 114/363 |
| 5,207,604 | 5/1993 | McMillin | 440/62 |
| 5,496,198 | 3/1996 | King | 440/7 |

*Primary Examiner*—Stephen Avila

[57] ABSTRACT

An apparatus for controlling a trolling motor, comprising a rotatable, foot-operated bearing assembly operationally connected to the trolling motor so that rotational motion of the bearing assembly is transferred to produce rotation of the trolling motor. The apparatus is configured so that, regardless of whether the trolling motor is mounted to the front or the back of the boat, the boat will move in the direction of rotation of the bearing assembly. In one embodiment of the invention, the bearing assembly may support a swivel chair whereby rotation of the chair results in rotation of the trolling motor.

99 Claims, 17 Drawing Sheets

FIG 3
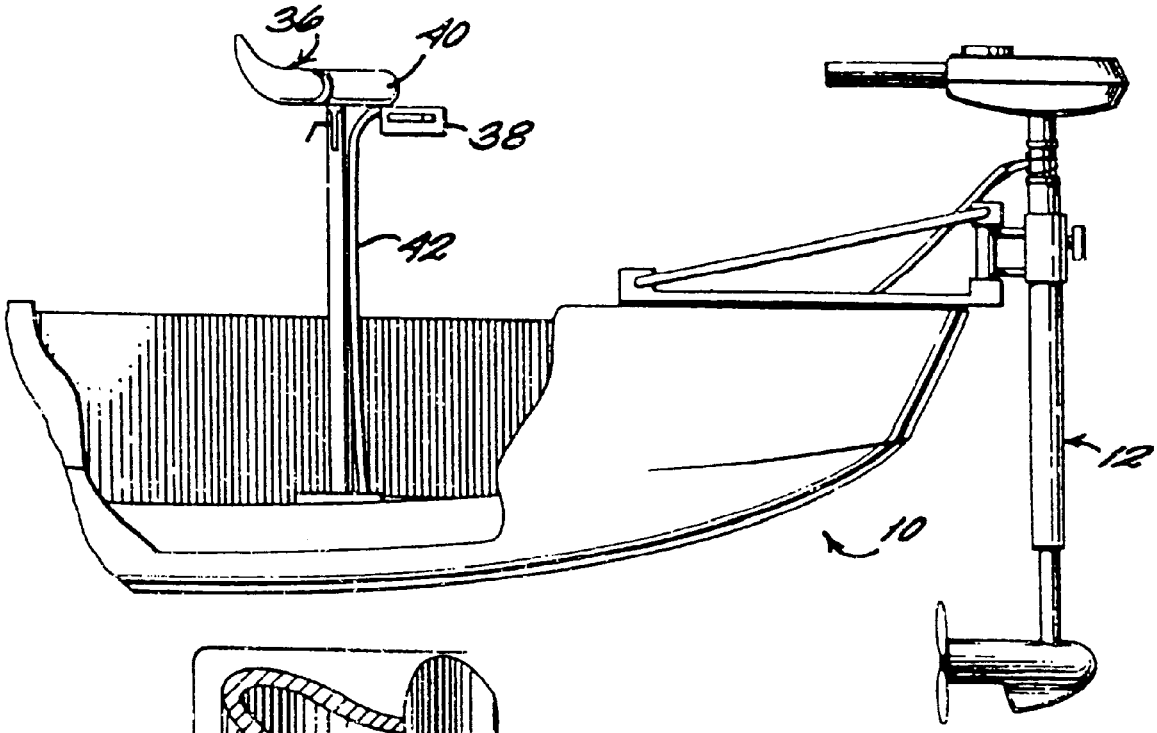
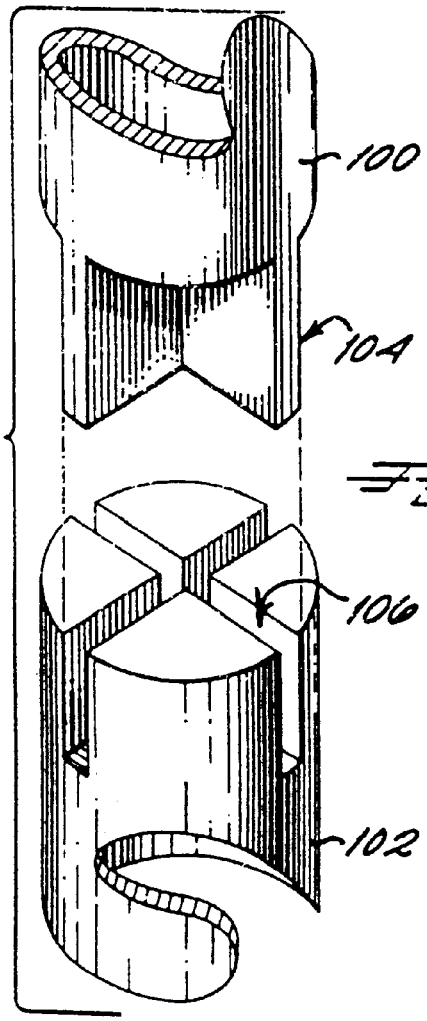
FIG 10

FIG 22
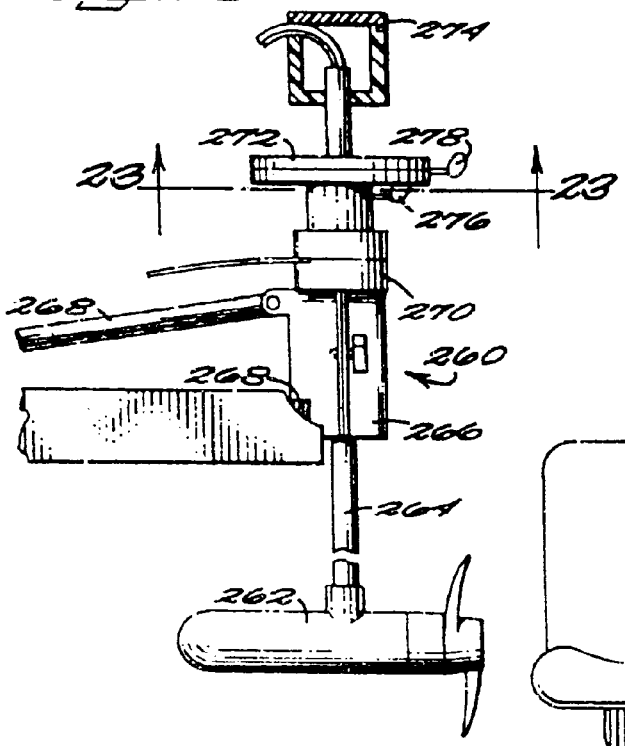
FIG 23
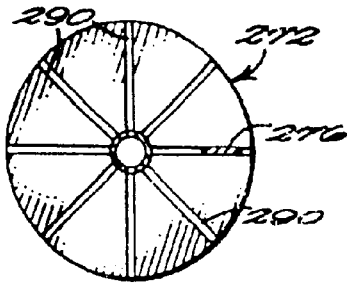
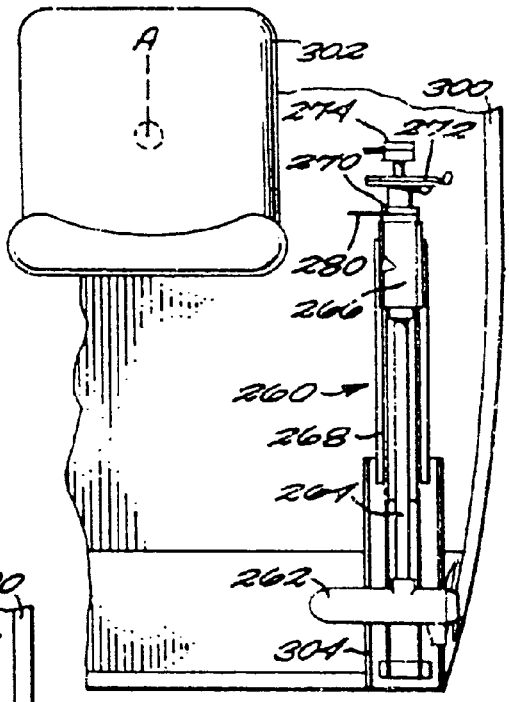
FIG 24A
FIG 24B
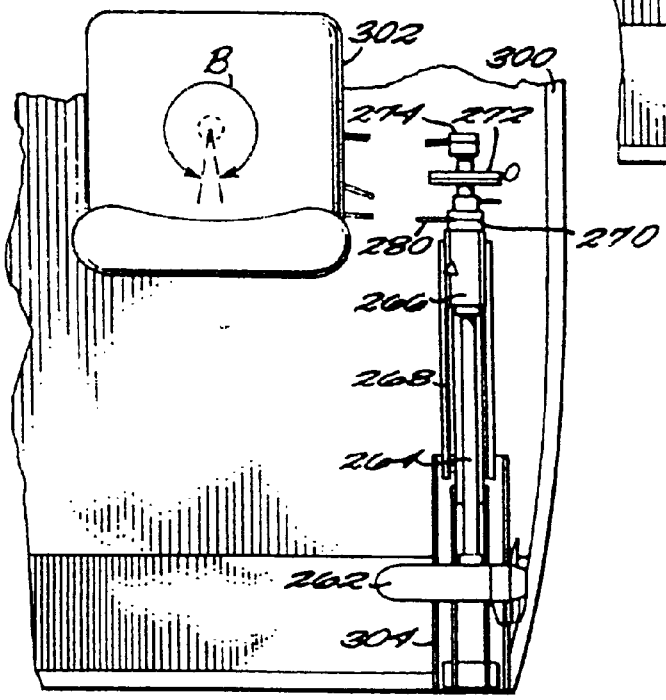

TROLLING MOTOR CONTROL APPARATUS

This application is a continuation-in-part of application Ser. No. 08/381,778, filed Feb. 01, 1995, now U.S. Pat. No. 5,496,198, which is a continuation-in-part of application Ser. No. 08/164,007, filed Dec. 08, 1993, now abandoned.

BACKGROUND OF THE INVENTION

1. Field of the Invention

The present invention relates generally to the operation of trolling motors used with fishing boats. In particular, the present invention relates to an apparatus that allows a user to operate a trolling motor to control the speed and direction of travel of a fishing boat. The present invention also relates to an apparatus that can be operated via a chair operationally connected to the trolling motor.

2. Discussion of Background

Fishing boats come in a variety of styles and with a variety of equipment. A fishing boat may be equipped with an inboard or outboard motor for propelling the boat from place to place on a body of water such as a lake or stream. Many boats are also equipped with the small outboard electric motors commonly known as "trolling motors." A trolling motor is usually smaller, quieter, and less powerful than the main outboard motor of the boat, thus, it is useful for maneuvering the boat quietly and slowly across the water in a manner less disturbing to fish. In a boat so equipped, a fisherman can fish while the boat is under way (propelled by the trolling motor), and/or after the boat has stopped (as used herein, the term "fisherman" refers to persons of either sex who are engaged in the sport of fishing). If the boat is in a moving body of water, the trolling motor can be used to maintain or restore the position of the boat. The use of a trolling motor maximizes the options available to the fisherman. Others find boats equipped with trolling motors to be useful for observing wildlife, sightseeing, and other outdoor activities.

Trolling motors may be controlled by foot-operated controls, hand-operated controls, or a combination thereof For example, the angle of the motor (thus, the direction of travel of the boat) may be controlled by a tiller that controls the angle of the motor; and the motor head may have an on/off switch, speed control, and forward/reverse switch. In some types of motor, some or all of these may be replaced by foot-operated switches. Many users find that foot-operated controls are more convenient for use while fishing. Although such foot-operated control systems provide the fisherman with free use of his hands, presently-available systems may be inconvenient or difficult to operate.

There have also been attempts to control a trolling motor from a rotatable chair by coupling the rotation of the chair to the angle of the motor. However, these have proved to be unsatisfactory because the achievable range of motion is limited and because of the potential for the linkages between the chair and the motor to bind. Furthermore, the force required to turn the motor with a single cable or linkage system can be considerable. Consequently, there remains a need for an effective and convenient way to operate a trolling motor in order to control the direction of travel and speed of a fishing boat.

SUMMARY OF THE INVENTION

According to its major aspects and broadly stated, the present invention is an apparatus for controlling the operation of a trolling motor of a boat. As used herein, the terms "control" and "operate" refer to activating the motor (i.e., starting and stopping the motor), operating the motor in the forward and reverse directions, changing the direction of travel of the boat by changing the angle of the motor, and changing the speed of the motor. Control is exercised from a foot-operable bearing assembly rotatably mounted in the boat so that rotation of the bearing assembly rotates the trolling motor. The bearing assembly is operably connected to the shaft of the trolling motor by at least one cable, thus, rotation of the bearing assembly rotates the trolling motor to change the direction of travel of the boat. The user may operate the apparatus while standing, or, if preferred, while seated in a rotatable chair mounted to the bearing assembly.

An on/off switch (or, in some embodiments, a forward/off/reverse switch or polarity switch) is connected to the bearing assembly. The switch is operable either by movement of the foot or the upper leg of the user, or by movement of the chair. In one preferred embodiment of the present invention, the switch is a locking, foot-operated switch so that the user can start the motor by pressing the switch with his foot, and stop the motor by pressing the switch again. In another embodiment of the invention, the switch is activated by rocking the foot or by stepping on the on-off button, or by tilting of the chair. Other positions of the switch may be used; for example, placement on the arm of the chair for activation by the user's arm, or on the back of the chair for activation by leaning backwards.

The apparatus may also include a speed control switch to change the speed of the motor, and/or a polarity switch to change the direction of travel of the motor. These switches, if present, are operably connected to the bearing assembly, For example, the switches may be incorporated into the bearing assembly for convenient activation by the user's hand or foot whether standing, or whether sitting in a chair mounted to the bearing assembly.

The present invention also includes means for disconnecting the movement of the bearing assembly from the motor, thereby allowing the user to rotate a chair mounted to the bearing assembly without rotating the trolling motor. This feature is used when the motor is pulled up out of the water, or when the fisherman wishes to change his own seated position relative to the boat while the boat itself remains stationary.

An important feature of the present invention is its versatility and adaptability for use with a wide range of boat designs, preferred fishing styles, and fishing conditions (weather conditions, current flow, species of fish, and so forth). This ready adaptability allows the user to control the operation of the trolling motor either by using his foot or by rotating a chair mounted to the bearing assembly, leaving his hands free for working with fishing equipment. By way of example, the bearing assembly may be mounted in a suitably-dimensioned cavity in the boat, or it have a bottom surface that is approximately flush with the boat when mounted thereon. Preferably, the bearing assembly has means formed therein for securing a swivel chair, such as a low fishing chair, the type of fishing chair commonly known as a "high seat," or a chair that can be adjusted in height to suit the user (the chair itself may be permanently secured to the bearing assembly, or of a type that can be temporarily secured for easy removal at the user's convenience). The switches may be carried by the bearing assembly itself or mounted in some other convenient location, and the assembly may be fitted with a substantially weatherproof and waterproof cover to protect it from the elements. As will be explained further below, the user can operate the apparatus while sitting or standing, with or without a chair secured to the bearing assembly.

Another important feature of the present invention is the rotating of the trolling motor in correspondence with the rotating of the bearing assembly. Furthermore, there are several aspects of this feature that are individually significant. For example, the direction of movement of the boat is reflected in the direction of rotation of the bearing assembly (and, if a chair is mounted to the bearing assembly, in the direction of rotation of the chair): if the bearing assembly is rotated to the left, the boat turns to the left, whereas if the bearing assembly is rotated to the right, the boat turns to the right. This feature gives the user a sense of direction, since he need only turn his body in the direction he wants the boat to travel; no other direction indicators are required. This feature is especially convenient when moving in reverse: when seated in a chair mounted to the bearing assembly, the user simply rotates the chair so that he can look in the direction he wants to go; the motor rotates correspondingly so that the boat moves in that direction.

In one embodiment of the invention, the motor rotates through a preselected number of arcuate degrees for each arcuate degree of rotation of the bearing assembly. This feature enables the user to effect a quick and complete response of the trolling motor with a relatively small rotation of bearing assembly. It also enables him to fish facing the shore of a lake or stream while the trolling motor propels the boat approximately parallel to the shore, and to have a very good sense of the boat's direction of travel without having to look at the trolling motor to determine its orientation. The user still simply turns his body the way he wants the boat to travel. The specifics of the operation of the chair and trolling motor that produce these advantages will be described more fully below.

Another feature of the present invention is the use of at least one flexible cable to connect the bearing assembly and the trolling motor. Flexible cables are less likely to bind than a rigid linkage, and, when used to pull on a pulley, produce smooth movement of the trolling motor in either direction. Preferably, the cable (or cables) is contained in a flexible, substantially weather-proof and waterproof housing for durability in use. The cables connecting the first and second shafts run approximately parallel to each other to cause the shafts to turn in the same direction. Therefore, when the first shaft is mounted on the front of the boat, the direction of travel of the boat is the direction in which the seat is turned. When the first shaft is placed on the back of the boat, the cables are crossed to enable the boat to travel in the direction the bearing assembly is turned.

Still another feature of the present invention is the use of a foot-operable "on/off" switch (a plurality of such switches may be provided, one for each trolling motor speed). The switch is in operational connection with the bearing assembly, preferably carried by the bearing assembly or mounted nearby for ready access by a seated or standing user. Depending on the selected position of the switch, it may be operated by the user's foot (whether the user is standing or sitting in a chair mounted to the bearing assembly) by pressing the knee or thigh against an on-biased switch, or by tilting the chair.

Yet another feature of the present invention is the ability to decouple the trolling motor from the bearing assembly. This allows the user to rotate a chair mounted to the bearing assembly without rotating the trolling motor, for example, when the user does not wish to operate the motor, when the motor is retracted from the water, or simply when the user wishes to rotate the chair without also rotating the trolling motor.

Another feature of the present invention is the option, in some embodiments, of orienting a chair mounted to the bearing assembly in any desired position with respect to the boat.

Other features and advantages of the present invention will be apparent to those skilled in the art of trolling motor control from a careful reading of the Detailed Description of Preferred Embodiments presented below and accompanied by the drawings.

BRIEF DESCRIPTION OF THE DRAWINGS

In the drawings,

FIG. 3 is a side view, partially cut away, of a boat with a trolling motor mounted to the front of the boat and controlled in accordance with another preferred embodiment of the present invention;

FIG. 10 is a detailed, exploded view of the seating of the chair shaft to the bearing assembly in accordance with a preferred embodiment of the present invention;

FIG. 22 is a side, partially cross sectional view of a trolling motor according to another preferred embodiment of the present invention;

FIG. 23 illustrates the direction plate shown in FIG. 22, along the lines 23—23 of FIG. 22;

FIGS. 24*a* and 24*b* are top views of a portion of a boat equipped with a trolling motor and a control apparatus according to the present invention, showing the trolling motor in a stowed position with the direction plate engaged and disengaged, respectively;

DETAILED DESCRIPTION OF PREFERRED EMBODIMENTS

Figure 1:
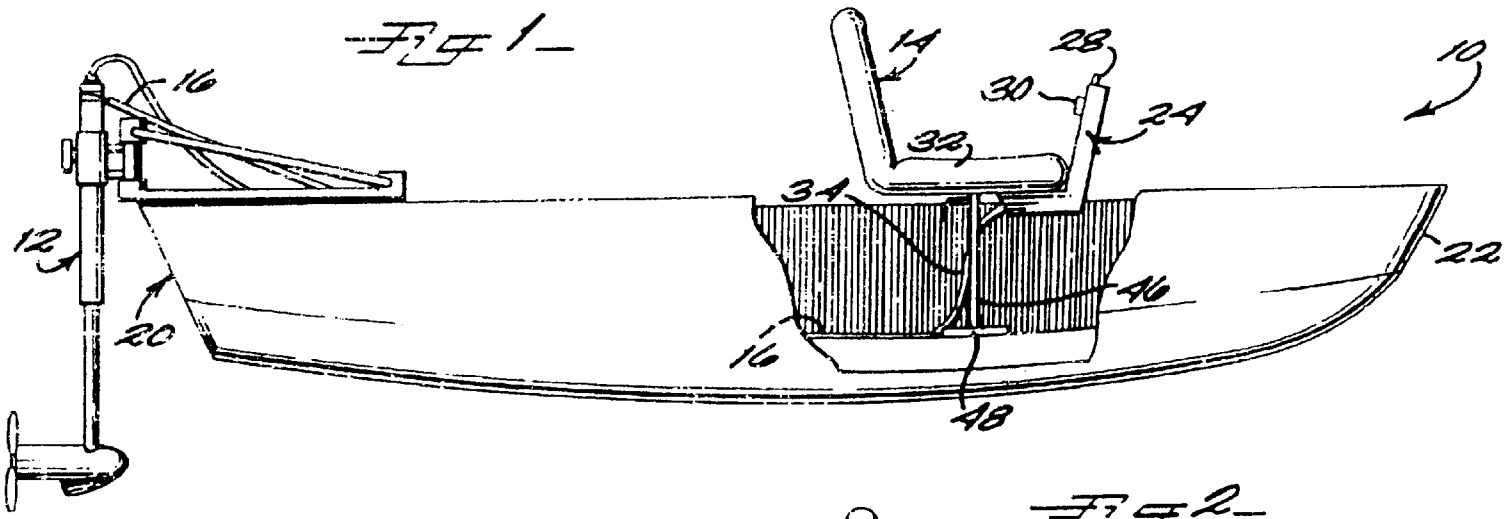
FIG. 1 is a side view, partially cut away, of a boat with a trolling motor mounted to the back of the boat and controlled in accordance with a preferred embodiment of the present invention.

In the following description, like reference numerals are intended to identify the same structural elements, portions or surfaces consistently throughout the drawings, as such elements, portions or surfaces may be further described or explained by the entire written specification.

The present invention is a method and apparatus for controlling the trolling motor of a fishing boat—its activation, direction of orientation, speed, and polarity—using a variety of techniques that make control simple and convenient for the user, regardless of whether the user is sitting or standing. Generally, trolling motor controls are positioned on the motor itself However, these controls are out of a fisherman's reach when he is not directly by the motor, for example, when sitting on a fishing chair (including the type of chair known as a "high seat") in the boat, standing in the back or front of the boat, etc. The present invention enables a fisherman to control the trolling motor in a "hands free" mode, thereby allowing more complete concentration on the act of fishing. In a preferred embodiment of the present invention, the fisherman uses foot-operated controls to start and stop the motor, to adjust the speed of the motor, and to rotate the motor to change the direction of travel of the boat. In another preferred embodiment of the invention, he or she rotates a chair to rotate the motor. If desired, the trolling motor can be readily decoupled from the seat controls, so that the fisherman can swivel the chair without rotating the motor.

Figure 2:
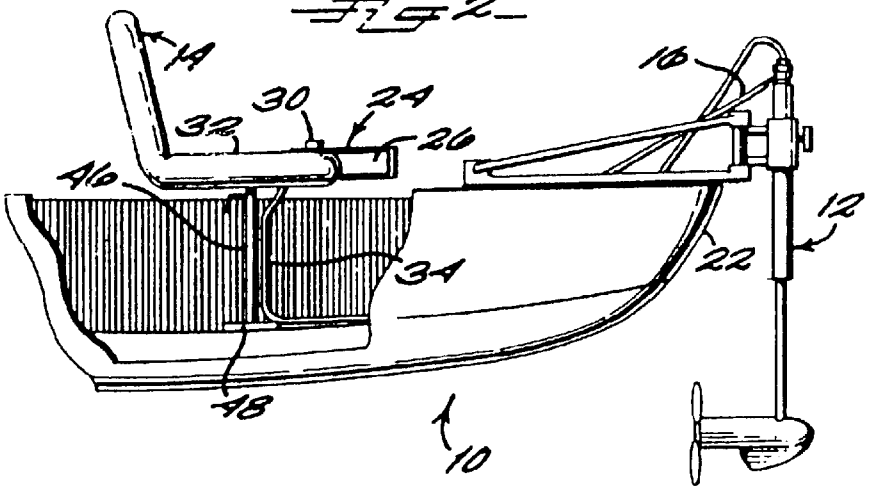
FIG. 2 is a partial side view, partially cut away, of a boat with a trolling motor mounted to the front of the boat and controlled in accordance with a preferred embodiment of the present invention.

Referring now to FIGS. 1 and 2, there is shown a preferred embodiment of the present invention mounted to a boat 10 having a battery-operated trolling motor 12 and a swivel chair assembly 14. Trolling motor 12 is preferably battery-operated; however, other means of supplying power to motor 12 are within the spirit of the present invention. Chair assembly 14 is connected to trolling motor 12 by a cable assembly 16, to be described in more detail below.

In FIG. 1, trolling motor 12 is mounted to a back or stern 20 of boat 10, where motor 12 will push boat 10; in FIG. 2, trolling motor 12 is mounted to a front 22 of boat 10 where it will pull boat 10. The location for motor 12 is based on the type of boat, the type of fishing to be done, and the personal choice of the user. Boat 10 may also be equipped with an outboard or inboard motor; the motor is not shown and is not part of the present invention.

For controlling motor 12 from chair assembly 14, a control panel 24 is attached to a seat 32 of chair assembly 14. Control panel 24 includes an "on/off," or preferably a "forward/off/reverse" switch 26 that operates motor 12, a polarity switch 28 that reverses the direction of operation of motor 12, and a speed control switch 30 that allows two or more different speeds of motor 12 to be selected. FIG. 1 illustrates control panel 24 mounted so that the panel is between the knees of a user. Control panel 24 is connected electrically to trolling motor 12 by an electrical cable 34.

FIG. 2 illustrates an alternative embodiment wherein control panel 24 is mounted to the side of seat 32 where it is just outside the user's left knee. FIG. 3 shows still another embodiment wherein a high swivel chair (or "high seat") 36 has a control panel 38 mounted to a seat 40 for a fisherman to be seated higher than in the case of seat 32. Control panel 38 is positioned to be between the thighs of the user when the user is leaning against seat 40, and is connected to trolling motor 12 by an electrical cable 42. Preferred alternative embodiments of the present invention for use with a high swivel chair or with the chair removed will be described further below.

Figure 4:
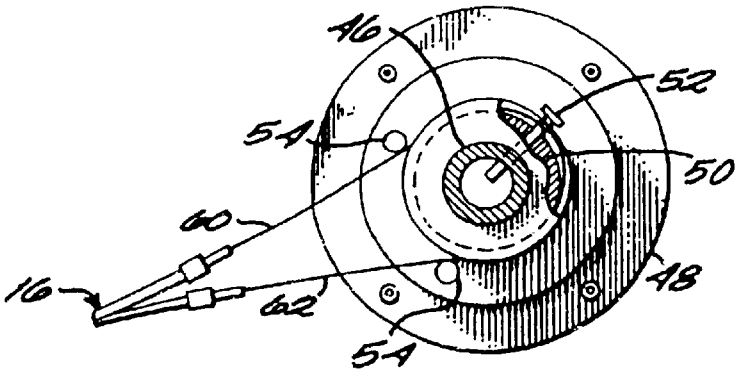
FIG. 4 is a top, partially cut away view of the pulley on the shaft of the chair in accordance with a preferred embodiment of the present invention.
Figure 5:
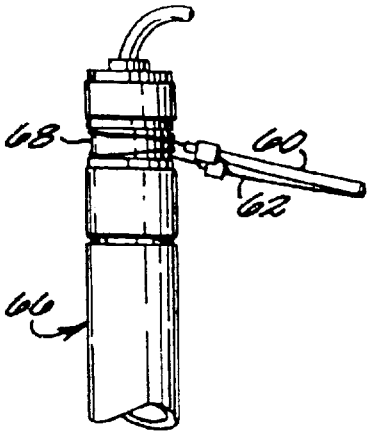
FIG. 5 is a side view of the pulley of the shaft of the trolling motor in accordance with a preferred embodiment of the present invention.

FIGS. 4 and 5 illustrate the details of the attachment of cable assembly 16 to swivel chair assembly 14 and trolling motor 12. Swivel chair assembly 14 has a shaft 46 that rotates with respect to boat 10 in a bearing assembly 48. Attached to shaft 46 and rotatable therewith is a pulley 50. Pulley 50 has a bolt 52 that travels between two stops 54, thus, when bolt 52 reaches either stop 54, it can go no further. Stops 54 are approximately 270° apart in order to give swivel chair assembly 14 a total of approximately 270° of rotation (that is, approximately 135° to either side of a forward facing position). It will be evident that a single stop 54 can be used in lieu of two stops to provide as much as 350° of rotation of assembly 14 and twice that (700° rotation) of trolling motor 12.

A pair of cables, a first cable 60 and a second cable 62, run around the circumference of pulley 50 at least as far as bolt 52, as shown, and preferably somewhat farther to maintain tension on cables 60, 62 throughout their full range of motion. Cables 60, 62 are brought together to travel to trolling motor 12 via cable assembly 16. As pulley 50 rotates in one direction, it pulls first cable 60; when pulley 50 rotates in the opposite direction, it pulls second cable 62.

Trolling motor 12 also has a shaft 66 with a pulley 68. First cable 60 and second cable 62 are connected to shaft 66 in a fashion similar to that used to connect the cables to pulley 50, except that first cable 60 is preferably positioned higher on shaft 66 than second cable 62 to prevent cable fouling. For reasons that will be set forth presently, the ratio of the diameter of pulley 50 to the diameter of pulley 68 is preferably approximately two, so that, for each degree of rotation of pulley 50, pulley 68 rotates two degrees. However, the diameters of pulleys 50, 68 may be selected so that each degree of rotation of pulley 50 produces a degree of rotation of pulley 60. Alternatively, other ratios may be used if desired.

Figure 6:
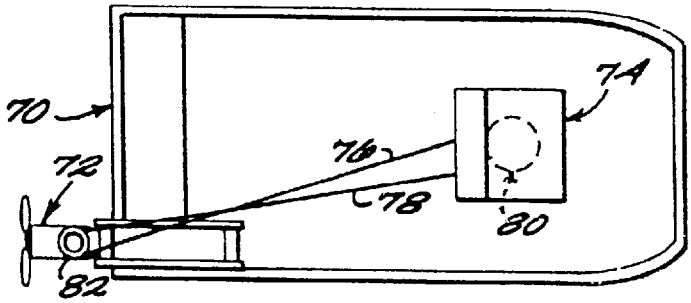
FIG. 6 is a top view of a boat with a trolling motor mounted to the back of the boat and controlled in accordance with the present invention.

FIG. 6 and FIGS. 7*a*–7*e* illustrate the specific operation of the present invention and its advantages. FIG. 6 shows a boat 70 with a motor 72 mounted on the back thereof. Swivel chair assembly 74 faces forward; motor 72 faces forward so that the motor can propel boat 70 forward. Cables 76 and 78 are shown crossing as they run from a first pulley 80 rotating with chair assembly 74 to a second pulley 82 rotating with motor 72.

Figure 7A:
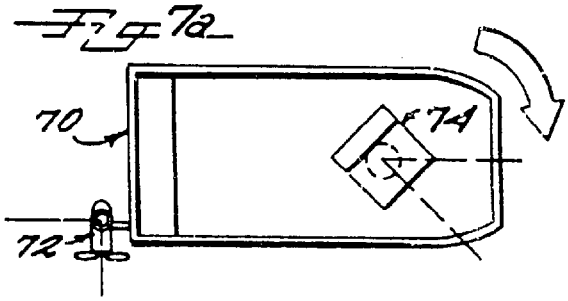
FIGS. 7*a–e* depict the boat of FIG. 6 with the seat rotated and the polarity of the trolling motor set in several different configurations.

FIG. 7*a* shows chair assembly 74 rotated to the right. Right rotation of chair assembly 74 rotates trolling motor 72 to face to the left, where motor 72 will push boat 70 so that the boat swings to the right (in the direction of rotation of chair assembly 74). If the diameters of pulleys 50, 68 are in the above-described 2:1 ratio, a 45° rotation of chair assembly 74 produces a 90° rotation of motor 72.

Figure 7B:
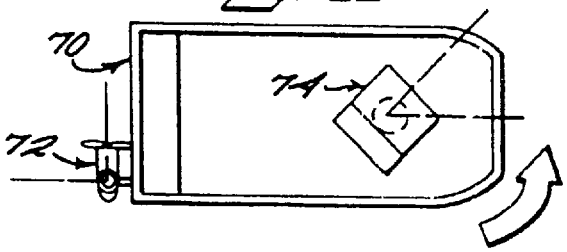
Figure 7E:
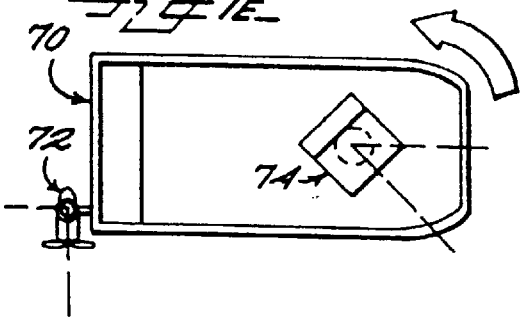

FIG. 7*b* shows a rotation of chair assembly 74 to the left by 45°, with a corresponding rotation of motor 72 to face the right by 90°, where the motor will push boat 70 to the left (again, in the direction chair assembly 74 was rotated).

Figure 7C:
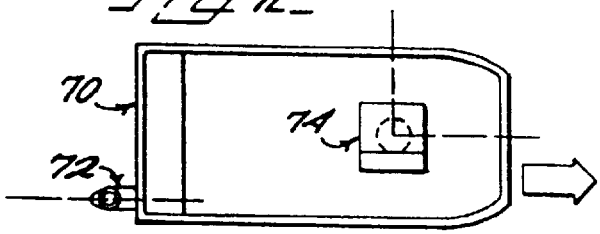
Figure 7D:
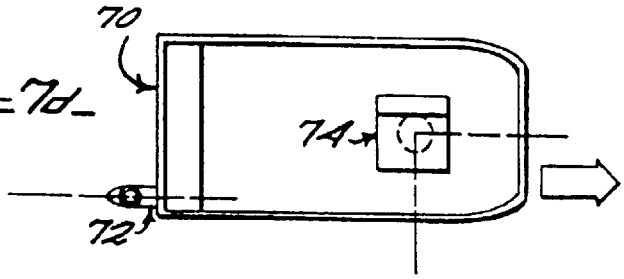

By rotating chair assembly 74 by 90° to either side of boat 70 so that motor 72 rotates 180° (as shown in FIGS. 7*c* and 7*d*) and reversing the polarity of motor 72 using switch 28 on control panel 24 (see FIG. 1), the user can fish to the side of boat 70 while it moves forward and parallel to the shore, or maintain a position parallel to the shore and headed into a stream current. Finally, in backing up boat 70 (FIG. 7*e*), the polarity of motor 72 is reversed using switch 28, and chair assembly 74 is rotated so that the user can look over his shoulder in the direction he wants boat 70 to go. Motor 72 rotates boat 70 as indicated by the arrow and moves the boat backwards, thus turning boat 70 to the left, as illustrated when chair assembly 74 is rotated to the right, resulting in an overall movement of boat 70 rearward and to the right.

Figure 8:
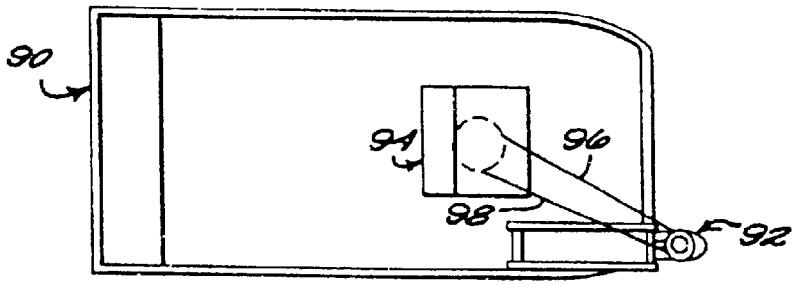
FIG. 8 is a top view of a boat with a trolling motor mounted to the front of the boat and controlled in accordance with the present invention.
Figure 9A:
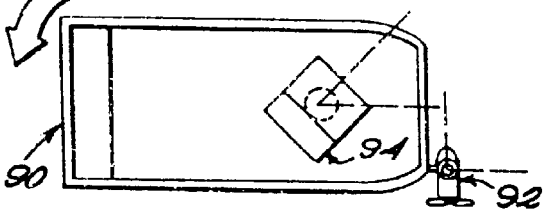
FIGS. 9*a–e* depict the boat of FIG. 8 with the seat rotated and the polarity of the trolling motor set in several different configurations.
Figure 9B:
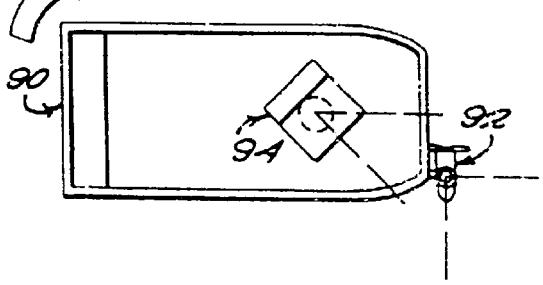
Figure 9C:
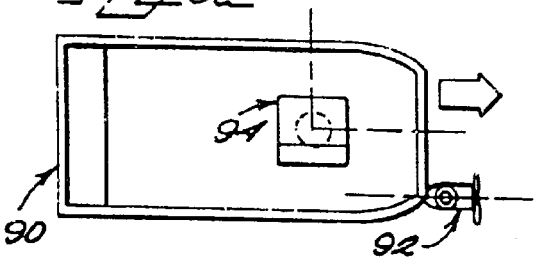
Figure 9D:
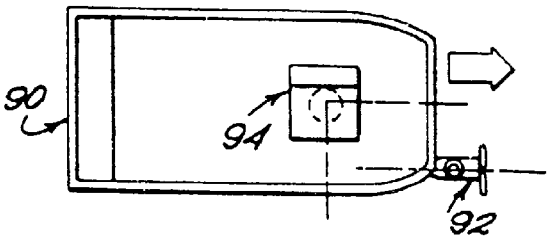

FIG. 8 illustrates a boat 90 with a motor 92 mounted in the front of the boat and connected to a swivel chair assembly 94 by a first cable 96 and a second cable 98. First and second cables 96, 98, do not cross because motor 92 will turn in the same direction as chair assembly 94. As seen in FIGS. 9*a* and 9*b*, rotation of chair assembly 94 to the left causes motor 92 to rotate to the left, where assembly 94 rotates boat 90 to the left (corresponding to the direction of rotation of assembly 94); correspondingly, rotation of chair assembly 94 to the right rotates motor 92 to the right, rotating boat 90 to the right. As with a rear-mounted motor, rotation of chair assembly 94 by 90° to either side of boat 90, thereby rotating motor 92 by 180°, and reversing the polarity of motor 92 with switch 28, will enable fishing from the side of boat 90 as it is propelled parallel to shore, as illustrated in FIGS. 9*c* and 9*d*.

Figure 9E:
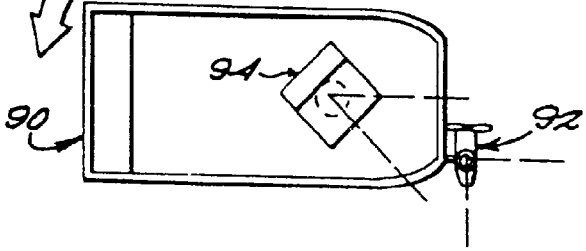

Backing up is performed as described above for a rear-mounted motor: the user rotates chair assembly 94 (FIG. 9*e*) with polarity switch 28 in the reverse direction, so that he can look over his shoulder in the direction he desires to move boat 90.

FIG. 10 illustrates a coupling for a swivel chair shaft 100 to a bearing 102. The end of shaft 100 has a cruciform shape 104 and fits into a corresponding double-grooved recess 106 in bearing 102. This coupling enables secure mating of shaft 100 and bearing 102, but allows the chair to be readily lifted and rotated to the side if the user wants to propel the boat with normal rather than reverse polarity while fishing from the side of the boat.

Figure 11A:
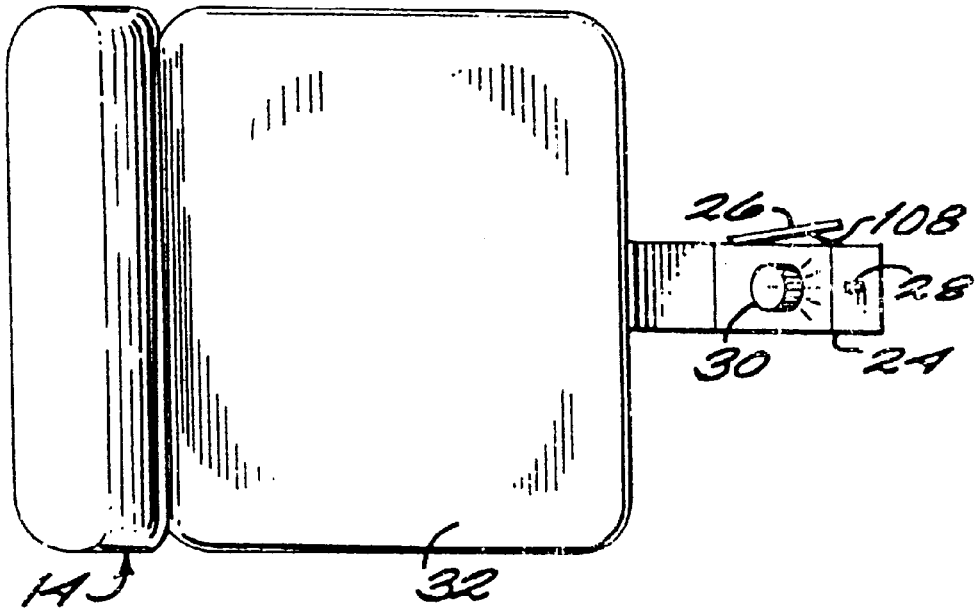
FIGS. 11*a* and 11*b* are a top view and a side view, respectively, of a control panel according to a preferred embodiment of the present invention.
Figure 11B:
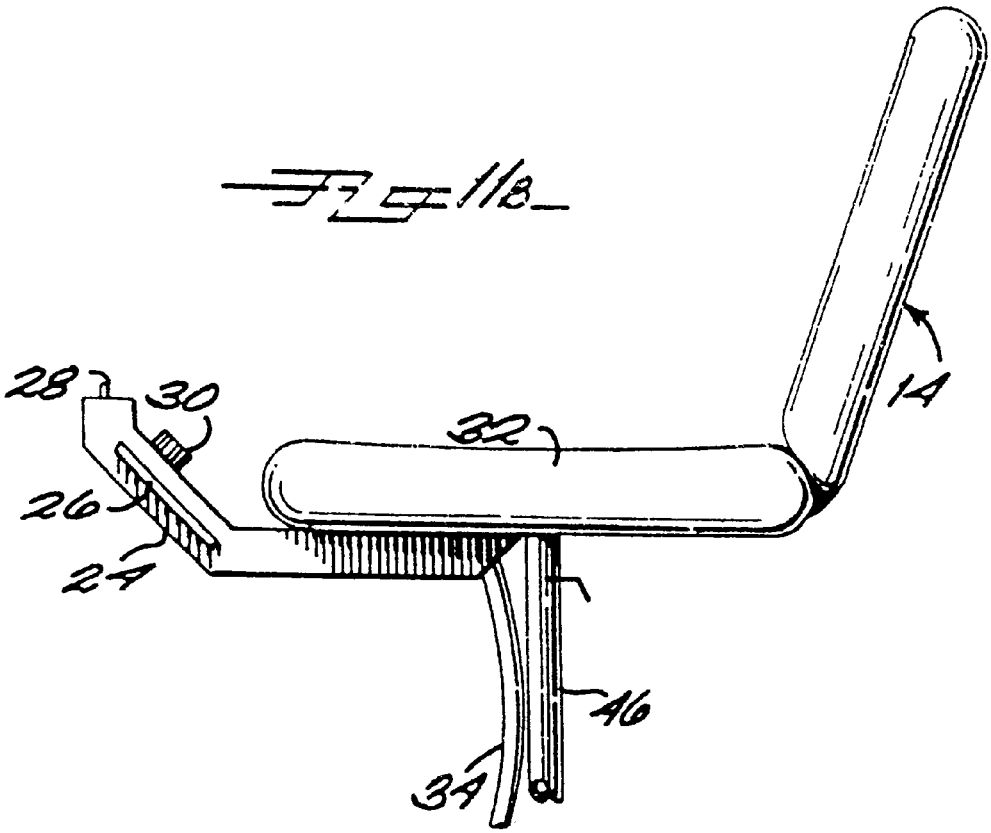

FIGS. 11*a* and 11*b* illustrate an embodiment of control panel 24. Control panel 24 is shown attached approximately to the middle of seat 32 so that on/off switch 26 is adjacent a user's knee on the inside of the leg, where movement of the leg presses switch 26 against a spring 108 to move switch 26 from the "off" position to the "on" position. This placement of switch 26 constitutes a safety feature because it requires continued pressure against the switch to keep the trolling motor in operation. This placement also enables the user to readily control the movement of boat 10 while leaving both hands free to handle fishing equipment. Control panel 24 also has polarity switch 28 and speed control switch 30. Speed control switch 30 can be of the type where specific speeds are selected (preferably, two of more speeds) or a continuous speed control switch similar to a rheostat, as may be preferred. On/off switch 26, polarity control switch 28, and speed control switch 30 are connected to motor 12 (FIG. 1) via a cable 34, and are in series with a battery (not shown) for operating motor 12.

Figure 12:
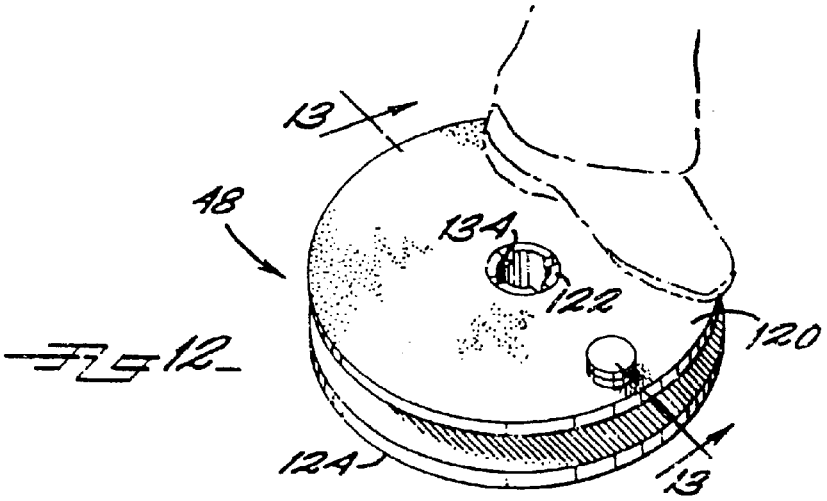
FIG. 12 illustrates the bearing assembly and an alternative embodiment of engagement with the shaft of a chair.
Figure 13:
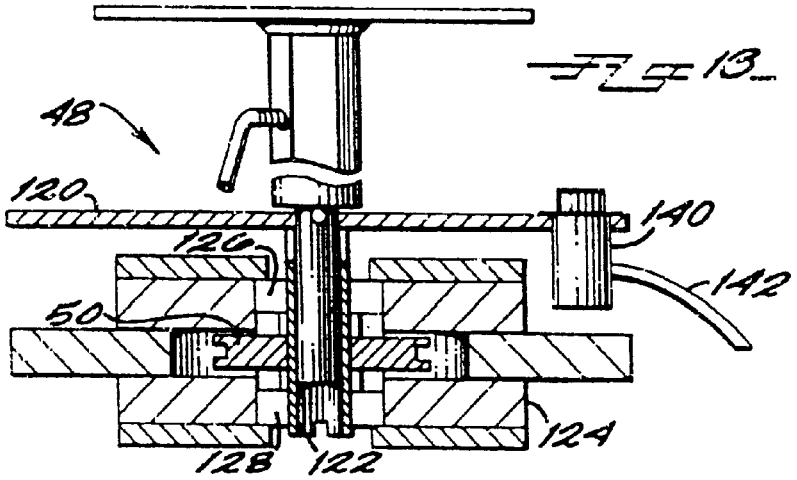
FIG. 13 is a perspective view of an alternative means for controlling the trolling motor in accordance with the present invention.

FIGS. 12 and 13 illustrate bearing assembly 48 in cross section. Bearing assembly 48 includes a top plate 120 surrounding an interior shaft 122 which turns freely with top plate 120. Pulley 50 is welded to shaft 122 so that the pulley rotates with the shaft. Bearing assembly 48 has a bearing housing 124 having two bearings 126, 128 in engagement with shaft 122 so that the shaft rotates freely within the bearing housing.

Figure 14:
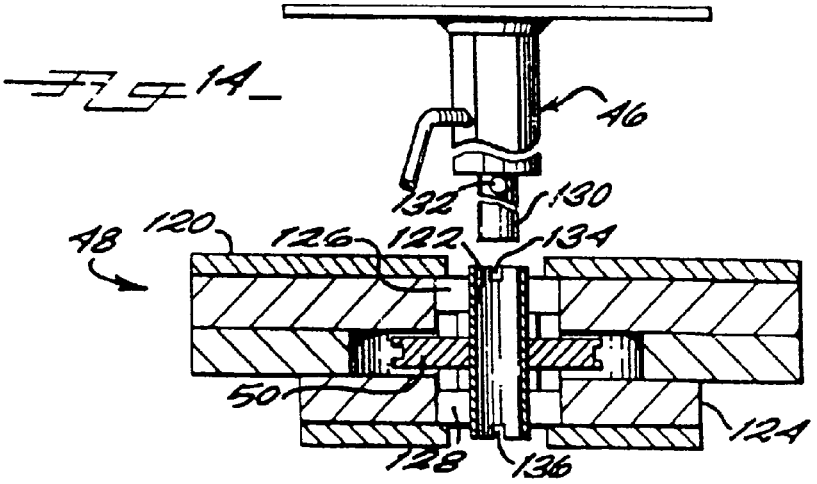
FIG. 14 is a side, cross sectional view of the trolling motor control means illustrated in FIG. 13.

Shaft 46 (FIG. 14) terminates in a reduced diameter portion 130 having a set of pins 132 located approximately 180° apart. Interior shaft 122 has four recesses 134 at its upper end that receive pins 132 and lock chair shaft 46 and interior shaft 122 together rotationally, but allow chair 14 to be lifted and rotated 90° for fishing from the side of boat 10. Interior shaft 122 may also have four recesses 136 at its other end so that, rather than reversing cables 60, 62, chair 14 can be removed temporarily and bearing assembly 48 can simply be turned upside down to uncross cables 60, 62 and chair assembly 14 repositioned.

Alternatively, top plate 120 can carry a foot-operated on/off switch 140 (or a forward/off/reverse switch having one or more forward positions and one or more reverse positions) that can be operated by a sitting or standing user. Switch 140 is connected to motor 12 by a cable 142 and is preferably biased to an open or off position. Simply by placing his foot on switch 140 on top plate 120, pressing switch 140 to activate motor 12, and then rotating his foot to steer boat 10, the user can maneuver boat 10 as desired.

To provide for switch 140, top plate 120 is elevated and welded to a longer interior shaft 122 (FIG. 14) so that plate 120 can rotate shaft 122, but otherwise can operate in the above-described fashion. This embodiment is especially suited for a front-mounted trolling motor, where the speed control switch and reverse polarity switch are on the motor, but the motor is within reach of bearing assembly 12 with or without chair assembly 14. Chair assembly 14 can be used for control when seated in the bearing assembly; alternatively, chair assembly 14 can be removed and the rotation of top plate 120 used to control boat 10.

Figure 15:
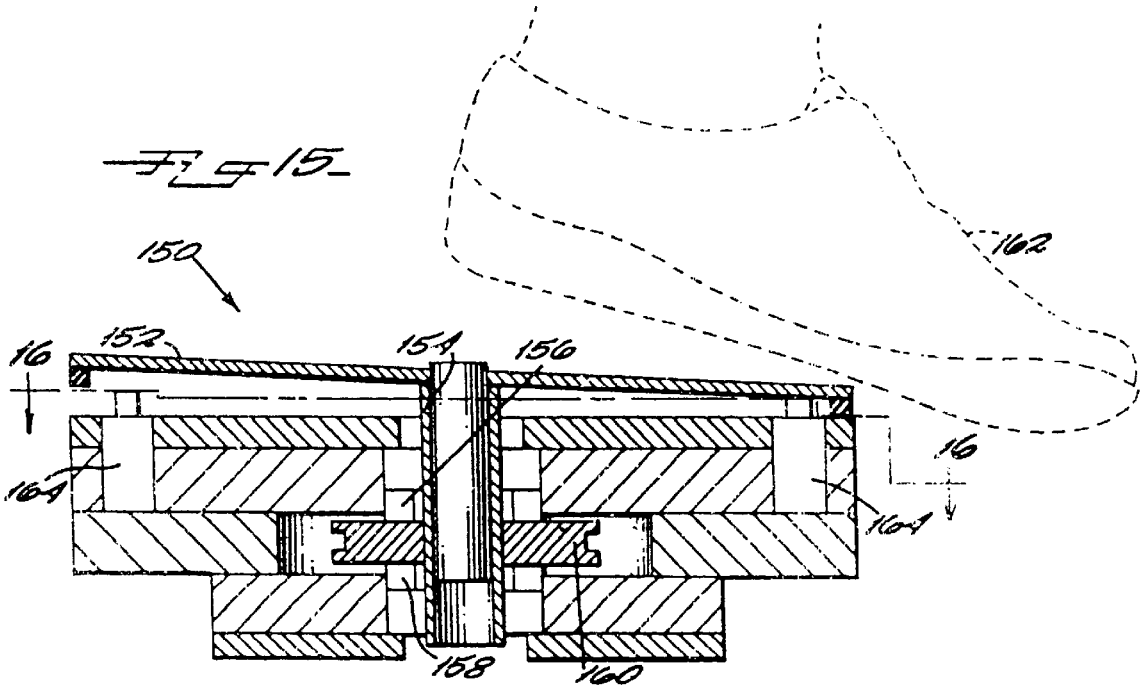
FIG. 15 is a side, cross sectional view of a means for controlling the trolling motor according to another preferred embodiment of the present invention.
Figure 16:
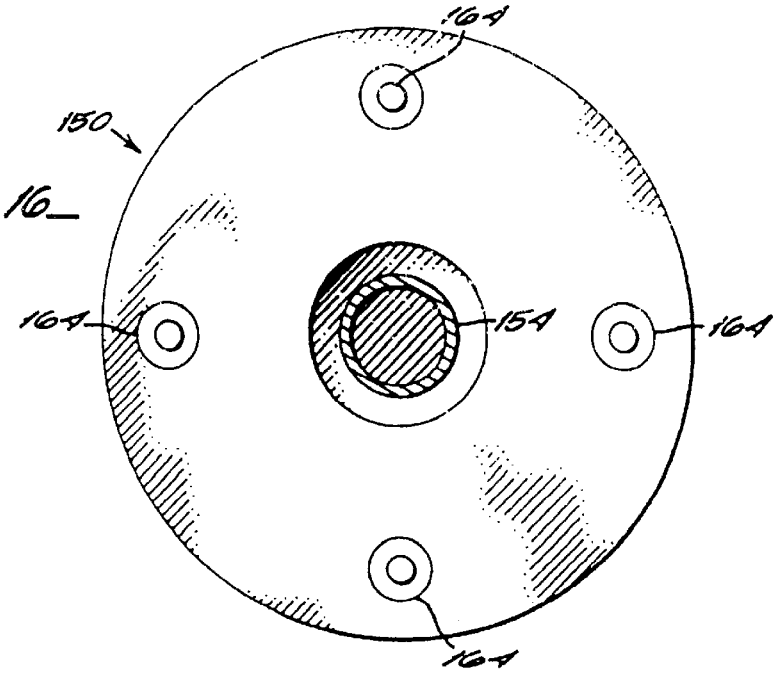
FIG. 16 illustrates the trolling motor control means of FIG. 15, taken along the lines 16—16 of FIG. 15.

In still another embodiment of the present invention, there is illustrated in FIG. 15 a side, cross-sectional view of a bearing assembly 150 having a top plate 152 surrounding an interior shaft 154 that rotates freely against two bearings 156, 158, to rotate a pulley 160. In this embodiment, as in that illustrated in FIGS. 12 and 13, bearing assembly 150 is rotated using a foot 162. However, instead of one switch that is operated by pressing foot 162 directly on switch 140, there are several switches 164, preferably four switches as illustrated in FIG. 16, that are activated by pressing down anywhere along the edge of top plate 152. Switches 164 are trolling motor on/off switches. Pressing on top plate 152 a first time activates trolling motor 12; pressing a second time deactivates trolling motor 12.

In the embodiment illustrated in FIG. 15 and FIG. 16, use of a chair is optional. If used, the chair seats into interior shaft 154 and can be used to rotate bearing assembly 150 (rather than rotating the bearing assembly 150 with foot 162); however, switches 164 are still operated by the user's foot 162.

Figure 17:
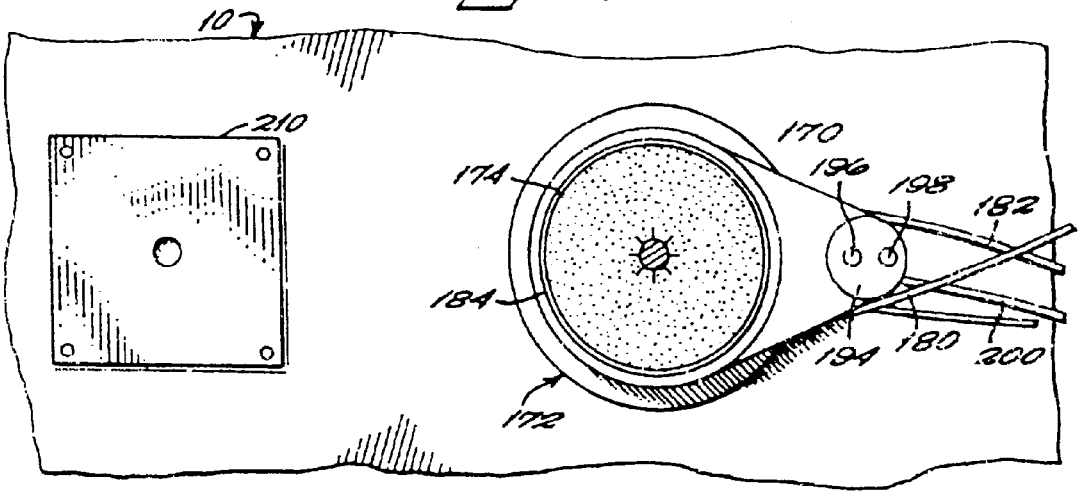
FIG. 17 is a partial top view of a boat with a trolling motor mounted to the front thereof and controlled in accordance with another preferred embodiment of the present invention, wherein the chair location can be altered from a first control position to a second control position.
Figure 18:
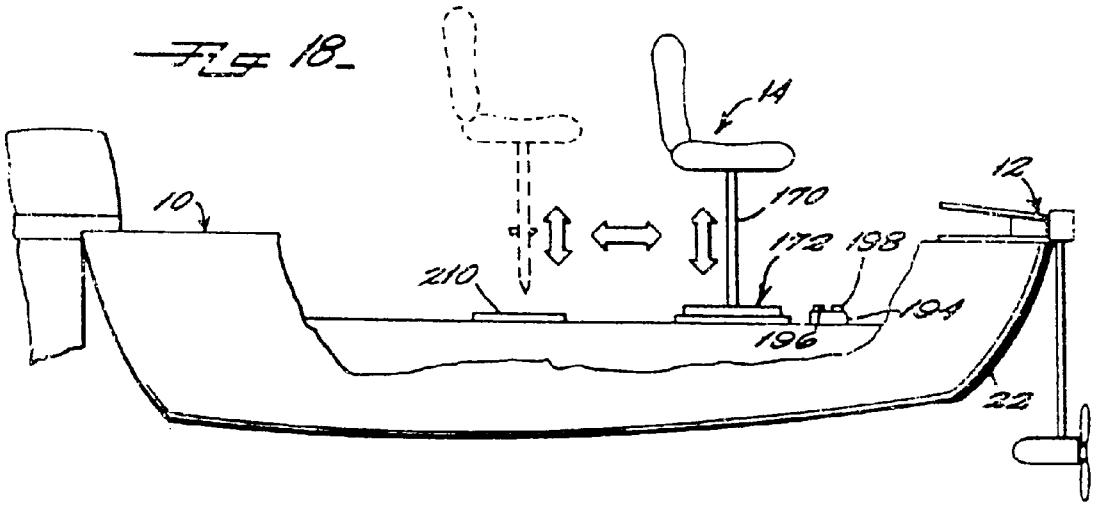
FIG. 18 is a side view, partially cut away, of a boat with first and second chair control positions as shown in FIG. 17.
Figure 19:
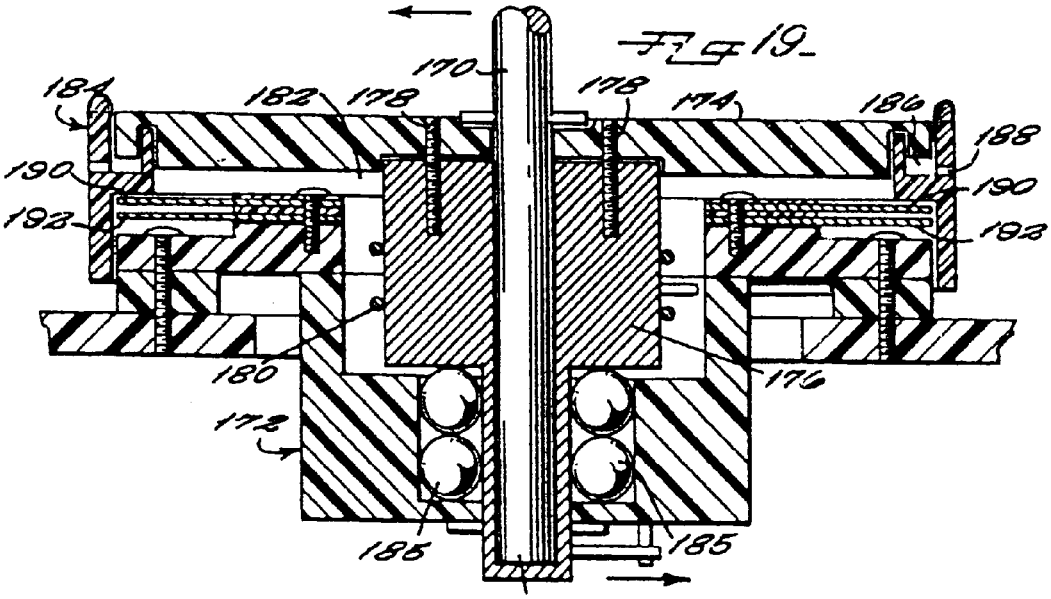
FIG. 19 is a detailed, cross-sectional view of the seating of a portion of a chair shaft in the bearing assembly, as also shown in FIGS. 17 and 18.

FIGS. 17, 18 and 19 illustrate still another embodiment of the present invention. In FIG. 18, trolling motor 12 is shown mounted to front 22 of boat 10 where it will pull boat 10. Alternatively, trolling motor 12 may be mounted to the back of boat 10 where it will push the boat. Swivel chair assembly 14 has a shaft 170 that rotates with respect to boat 10 in a bearing assembly 172. In the embodiment illustrated in these figures, the trolling motor on/off switch can be activated when the user presses with his foot on a part of the bearing assembly 172 or by tilting the chair, as will be described presently.

Bearing assembly 172 includes a plate 174, preferably made of a stiff material such as metal or a rigid plastic, and, as with above-described bearing assembly 48, a pulley 176 (FIG. 19) attached to top plate 174 by bolts 178 and rotatable therewith, and a pair of cables 180, 182 lead to trolling motor 12. Pulley 176 rotates freely against bearings 185. When a chair is attached to bearing assembly 172, shaft 170 is attached to pulley 176.

Bearing assembly 172 has a flexible, resilient cover 184, preferably made of plastic, that has three functions. First, cover 184 enables the trolling motor 12 to be turned on when the user presses down on it with the heel of a foot. Second, cover 184 protects the interior of bearing assembly 172 from water by an annular water channel 186 that catches water and directs it from cover 184 through holes 188 (FIG. 19). Finally, cover 184 allows the user's foot to remain in one position in relation to the floor when seated and activating the on/off switch with the foot (depending on the user's orientation with respect to bearing assembly 172, he may activate the on/off switch using his heel or some other portion of his foot, or by hand). When pressed, cover 184 will not rotate, but remains in stationary contact with the user's foot when chair assembly 14 is rotated. Therefore, the user's foot that operates the on/off switch controlled by cover 184 does not have to rotate with the chair and both feet can be used to push on the deck of boat 10 to turn chair assembly 14.

When the user is standing or has a foot on both plate 174 and cover 184, bearing assembly 172, including both plate 174 and cover 184, rotate together to rotate trolling motor 12 in steering boat 10. However, bearing assembly 172 includes two disk contacts 190, 192, that are normally spaced apart but, when cover 184 is pressed contacts 190, 192 come together and complete an electrical circuit connected with trolling motor 12. Completing or closing the circuit results in activation of trolling motor 12. Because disks 190, 192 are biased apart, cover 184 must be pressed to keep trolling motor 12 activated. Alternatively, the circuit is closed by making contact between disk contacts 190 and 192. Once closed by pressing cover 184, the circuit could be configured to remain closed, notwithstanding the release of cover 184, until contact between contacts 190, 192 is again made. Thereupon, the circuit could be opened until contact between contacts 190, 192 is made. Contacts 190 and 192 may be configured to turn with bearing assembly 172 or not, as may be preferred; contacts 190 and 192 may also be configured so as to control several speeds of trolling motor 12.

The user may also activate motor 12 by tilting chair 14, either by leaning back on the chair when seated or by pressing back on the chair when standing. When the user tilts chair 14, shaft 170 is deflected sideways as indicated at the top of FIG. 19, thereby deflecting plate 184 in a corresponding direction. The bottom of bearing assembly 172 then moves in the opposite, sideways direction, as indicated at the bottom of FIG. 19. When the internal components of assembly 172 are made of resilient, flexible materials, disks 190 and 192 will make contact if chair 14 is tilted far enough.

As also seen in FIGS. 17, 18, and 19 a stationary foot control 194 may include a push-button 196 which changes the direction of operation of trolling motor 12 from forward to reverse, and a knob 198 for speed control. Foot control 194 is connected electrically by cable 200 to trolling motor 12 and does not rotate with bearing assembly 172.

If desired, a base 210 can be provided for seat assembly 14 that is spaced apart from bearing assembly 172 when the user wants to control the movement and operation of trolling motor 12 entirely by foot, either while standing or while seated in a chair not coupled to the orientation of trolling motor 12. To change the location of seat assembly 14, the assembly is simply lifted from bearing assembly and moved to base 210.

Figure 20:
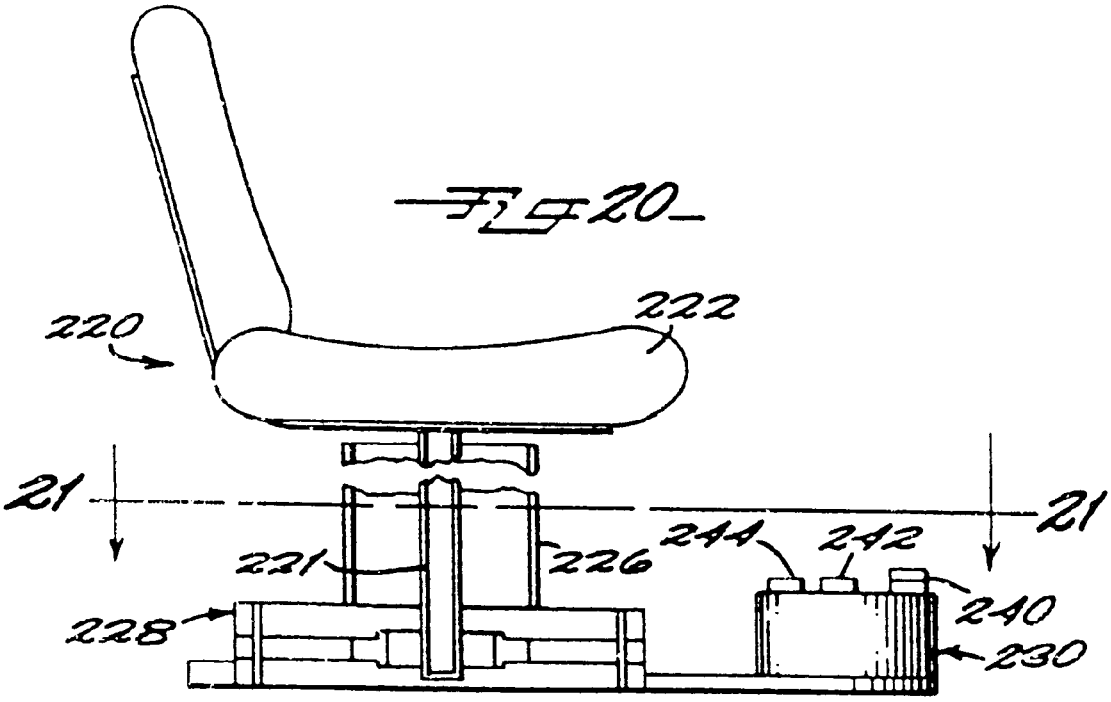
FIG. 20 shows another preferred embodiment according to the present invention, wherein operation of the trolling motor is provided by using a foot console.
Figure 21:
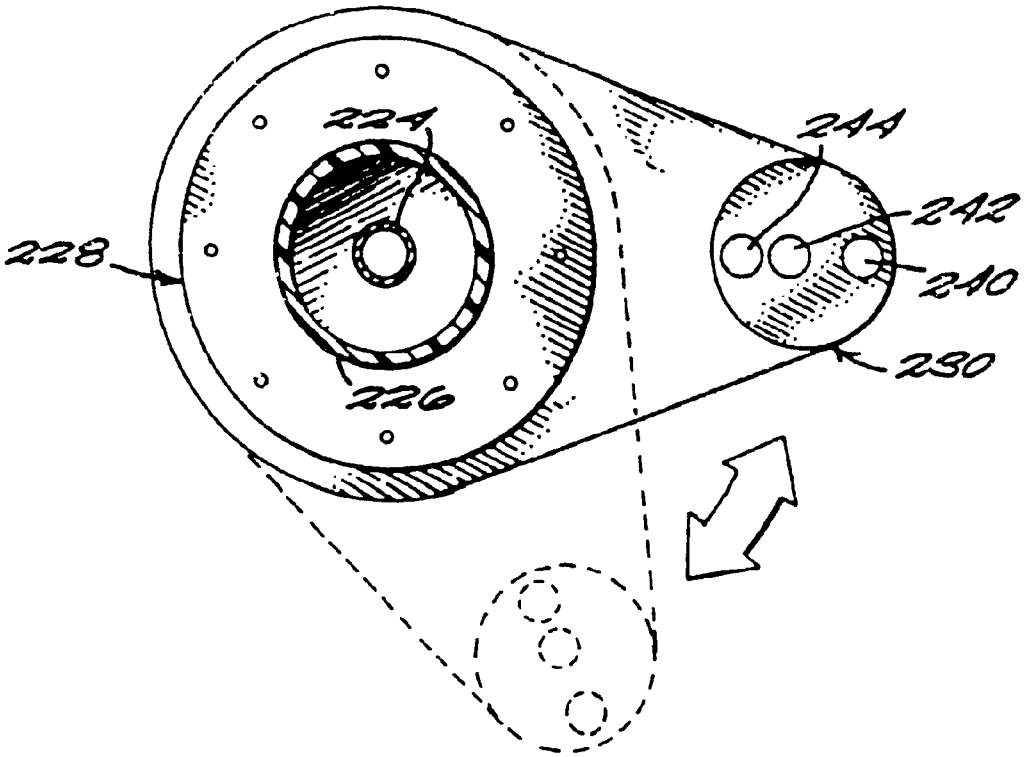
FIG. 21 shows the foot console of FIG. 20, taken along the lines 21—21 of FIG. 20.
Figure 26:
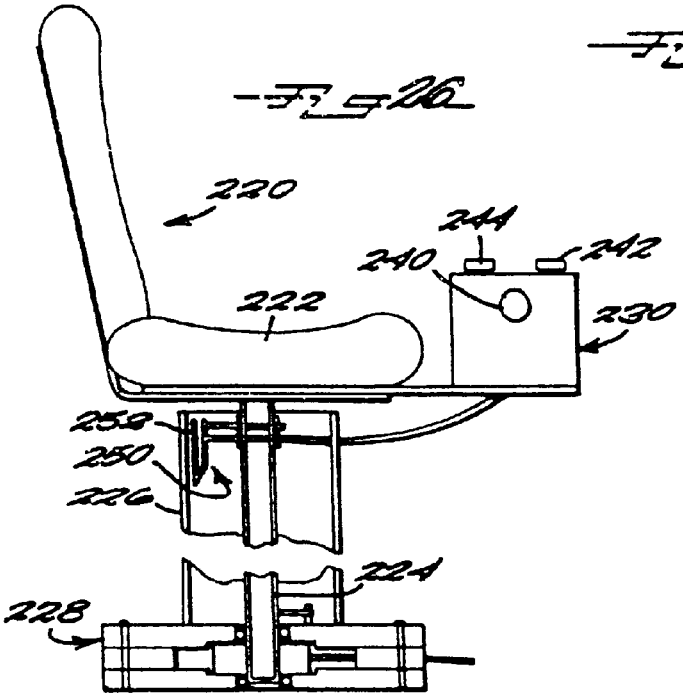
FIG. 26 is a partial cross sectional, side view of a tiltable chair-bearing assembly in accordance with another preferred embodiment of the present invention, wherein the chair can be tilted to activate the trolling motor.

FIGS. 20, 21 and 26 illustrate additional embodiments of a seat assembly 220 according to the present invention. FIG. 26 shows a seat assembly 220 with a seat 222 mounted onto a shaft 224 inside of a cylindrical housing 226 on a bearing assembly 228. Seat assembly 220 includes a rotating control panel 230 attached either to bearing assembly 228 or to seat 222. When attached to bearing assembly 228, control panel 230 is operated by the user's foot; when attached to seat 222, control panel 230 is operated by the user's hand and upper leg. In both configurations, control panel 230 rotates with bearing assembly 228. In the embodiment shown in FIGS. 20 and 21, control panel 230 can be rotated with respect to seat assembly 220 and bearing assembly 228, as indicated by the arrow in FIG. 21. For example, if the user changes the orientation of seat 222 with respect to bearing assembly 228, he may wish to change the location of control panel 230 so that switches 240, 242, 244 (FIG. 21) are more conveniently accessible.

Control panel 230 includes an on/off switch 240 to activate motor, a polarity switch 242 for motor direction, and a speed control knob 244. In the embodiments shown in FIGS. 20, 21, and FIG. 26, the on/off switches are preferably switches of the type that are depressed and kept depressed to keep trolling motor 12 in operation. Alternatively, the switches are locking switches of the type that are pushed once to turn motor 12 on, then pushed a second time to turn the motor off. Furthermore, rotation of bearing assembly 228 produces rotation of trolling motor 12.

In the embodiments shown in FIGS. 19 and 26, additional control for starting and stopping trolling motor 12 is available by tilting seat 222. A contact switch 250 (FIG. 26) located within cylindrical housing 226 is closed when seat 222 is tilted. Contact switch 250 comprises a pair of leads 252 secured to shaft 224. As seat 222 is tilted, leads 252 move toward housing 226. One of leads 252 is angled so that it will contact the other lead 252 when its motion is stopped by housing 226, which remains rigidly in place on bearing assembly 228. A slight, but sufficient tilt to close switch 250 will cause the activation of trolling motor 12 as long as seat 222 is kept tilted. A more extensive tilt results in switch 250 maintaining trolling motor in operation until seat 222 is tilted to the same extend a second time, which opens the circuit driving trolling motor 12.

If desired, additional switches (one switch for each speed of trolling motor 12) may be provided. It will be evident to those of ordinary skill that such switches could readily be configured so that the speed of motor 12 is proportional to the degree of tilt of seat 222.

Figure 27:
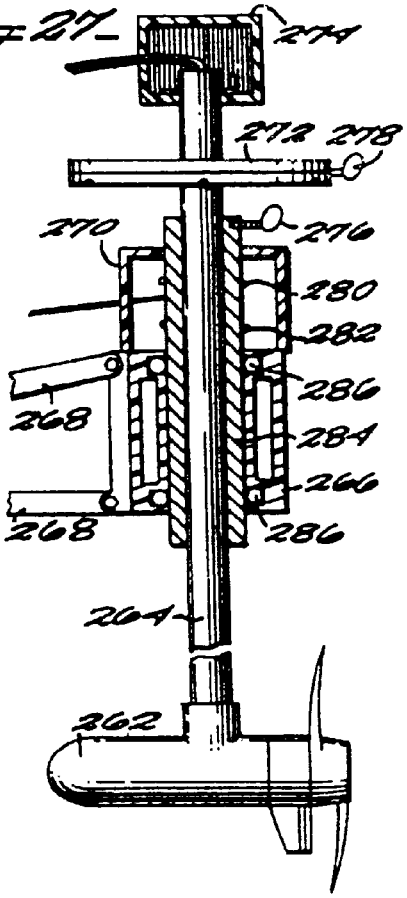
FIG. 27 is a side, cross sectional view of a trolling motor showing the motor in a decoupled position.

At times, it will be desirable to disconnect or decouple trolling motor 12 from the seat assembly control, for example, when the motor is to be retracted from the water and into the boat. The present invention includes a simple system for decoupling the motor from the seat assembly control, as illustrated in FIGS. 22, 23, 24*a*, 24*b*, 25*a*, 25*b*, and 27. FIGS. 22 and 27 show comparable views of a trolling motor 260 oriented as if in use and having a propeller assembly 262, a shaft 264, a housing 266, retraction linkages 268, a pulley housing 270, a direction plate 272, and an end cap 274. Additionally, a first key 276 is used to couple pulley 284 and direction plate 272; a second key 278 is used to indicate the orientation of propeller assembly 262.

The propeller of propeller assembly 262, which contains an electrical motor (not shown), is oriented via shaft 264 turned by cables 280 and 282 wound about pulley 284 in pulley housing 270 (shown in cross section in FIG. 27). Pulley 284 turns freely against bearings 286 in housing 266 and shaft 264 is free to slide vertically within pulley 284, and is shown lifted in FIG. 27 from the coupled position of FIG. 22 to a decoupled position. Pulley 284 and shaft 264 are coupled when first key 276 is turned so that it engages slots 290 in direction plate 272 (FIGS. 22 and 23), which couples direction plate 272 to pulley 284, and, therefore, couples the seat assembly to the trolling motor 260.

Figure 25A:
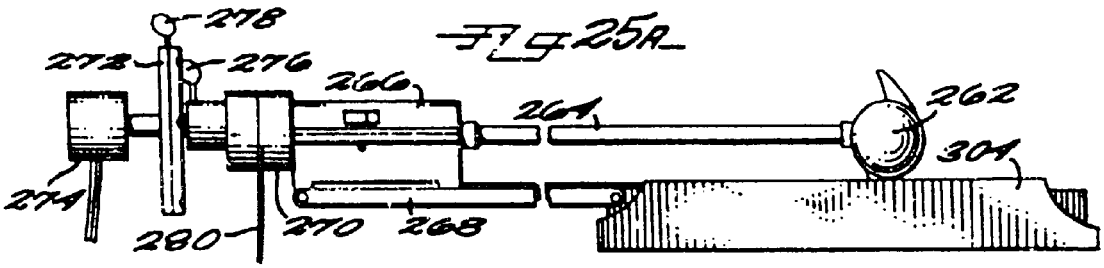
FIGS. 25*a* and 25*b* show side views of the trolling motor with the direction plate engaged and disengaged, respectively.
Figure 25B:
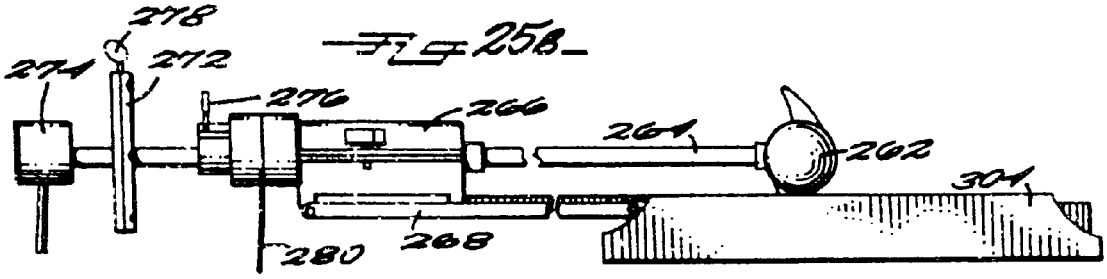

FIGS. 24*a* and 24*b*, and FIGS. 25*a* and 25*b* illustrate trolling motor 260 in the retracted position. FIGS. 24*a* and 24*b* are a top view of a portion of a boat 300 with trolling motor 260 retracted; FIGS. 25*a* and 25*b* are side views of trolling motor 260 in retracted position. FIGS. 24*a* and 25*a* correspond to each other and show the direction plate 272 of trolling motor 260 in position where it is coupled to pulley 284 so that trolling motor 260 is coupled to chair 302, and therefore, because trolling motor 260 is laying in a cradle 304 and not free to rotate, chair 302 is locked in place. FIGS. 24*b* and 25*b* also correspond to each other and show direction plate 272 decoupled from pulley 284 so that trolling motor 260 is decoupled from chair 302, thereby allowing chair 302 to rotate freely about a large angle B, as indicated. When first key 276 is turned sideways so that it cannot engage slots 290, direction plate 272 can be in engagement with pulley 284, rather than separated by sliding shaft as illustrated, and the two will not be coupled except for a small amount of friction. Second key 278 always indicates the orientation of propeller assembly 262. A plurality of slots 290 may be formed in the underside of direction plate 272, allowing the relative orientation of chair 302 and trolling motor 260 to be changed if desired.

Figure 28A:
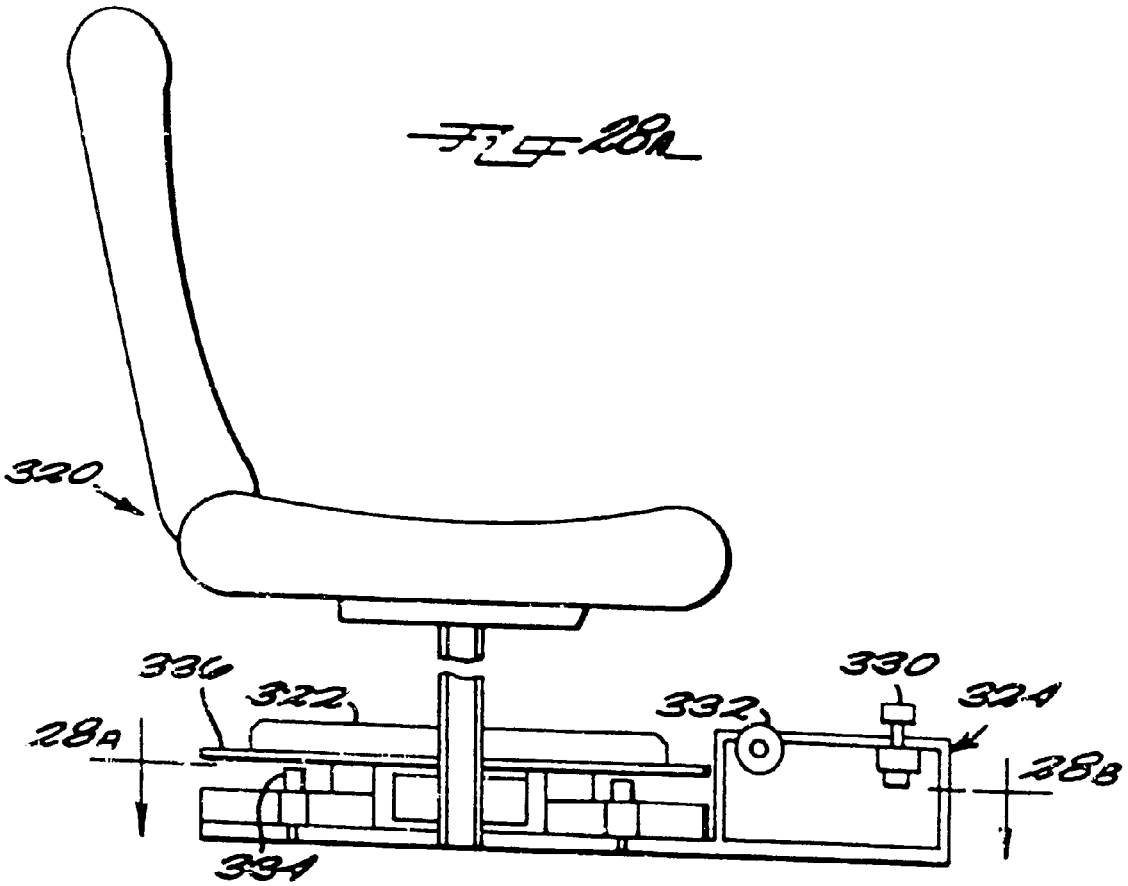
FIGS. 28*a* and 28*b* show a chair mounted to a bearing assembly with foot-operable controls according to another preferred embodiment of the present invention.
Figure 28B:
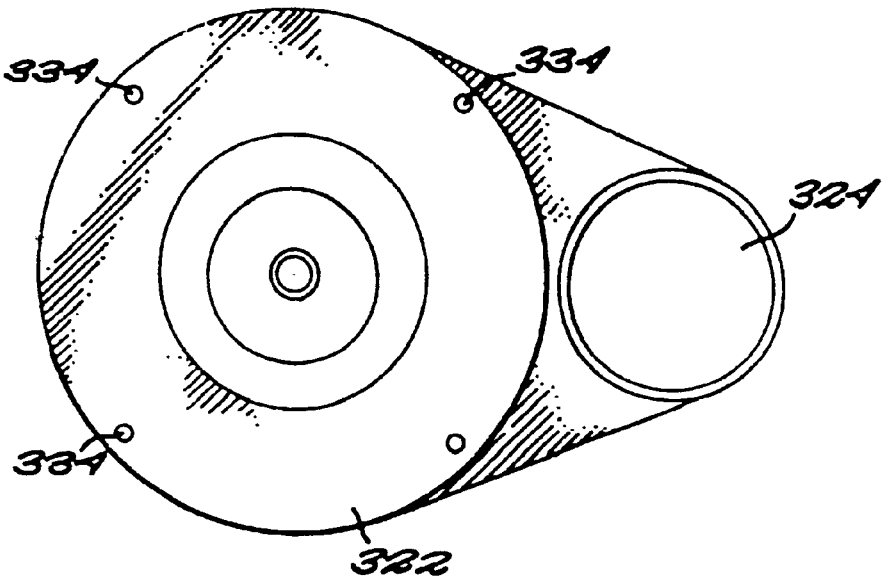

FIGS. 28*a* and 28*b* illustrate still another preferred embodiment of the present invention. FIG. 28*a* shows a side view of a chair 320 in a bearing assembly 322 that carries a foot control 324. FIG. 28*b* is a top view taken along lines 28*b*—28*b* of FIG. 28*a*. Foot control panel 324 includes a forward/reverse switch 330, a speed control switch 332, and one or more on/off switches 334 (four switches are shown) deployed about bearing assembly 322 under a flexible, resilient activation disk 336. If preferred, switches 334 can be constructed as shown in FIG. 19.

Figure 29A:
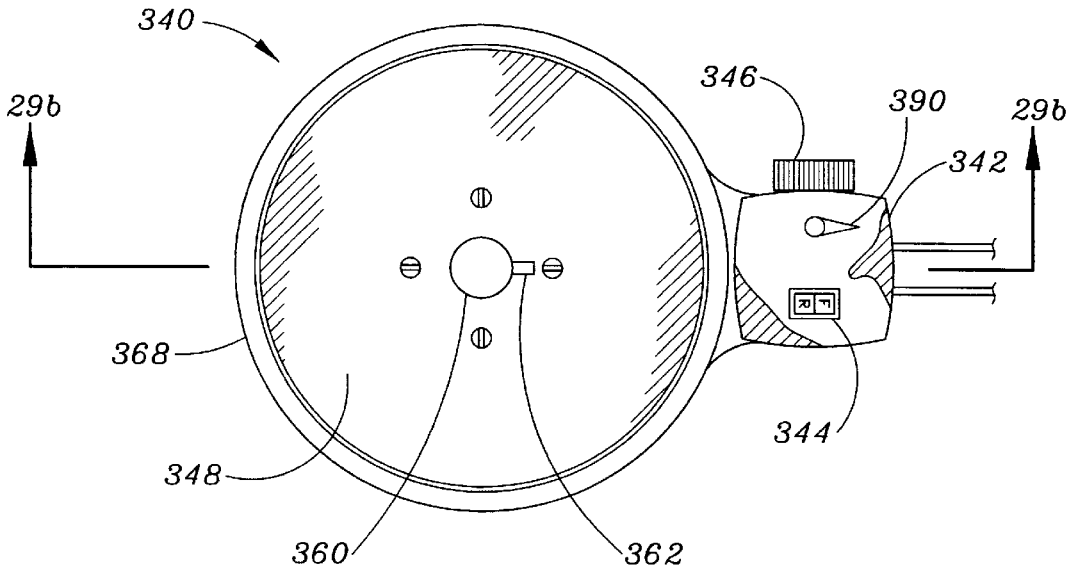
FIGS. 29*a* and 29*b* show illustrate another preferred embodiment of the present invention.

The radial position of chair 320 is fixed with respect to bearing assembly 322, thus, chair 320 turns with the bearing assembly about the second axis. Rotation of chair 320 does not affect the position of control 324, activation disk 336 and switches 334, which remain stationary. However, the user can easily operate activation disk 336 (and switches positioned thereunder) regardless of the direction that chair 320 is facing. control 324 by foot (or by hand if desired), either while sitting in It will be apparent to those of ordinary skill that other arrangements of the various components described above are within the spirit of the present invention. Thus, FIG. 29*a* is a top view of a bearing assembly 340 with a foot control panel 342. Foot control 342 includes a forward/reverse switch 344 and a rotatable, variable speed control switch 346. Bearing assembly 340 has a cover 348 attached to a pulley 350 by at least one (preferably, a plurality) of screws or other fasteners 352 (FIG. 29*b*), one of which acts as a pulley stop when contacting a stop 354. Cover 348, like above-described cover 184 of bearing assembly 172, enables the trolling motor to be turned on when the user presses down on the outer portion of the cover. In addition cover 348 protects the interior of bearing assembly 340 from water.

Bearing assembly 340 includes a recess 360 for receiving a chair such as chair 14. If desired, recess 360 may include a single groove 362 as shown, for locking chair 14 into position with respect to bearing assembly 340. Alternatively, recess 360 may have a plurality of such grooves that allow the user to position chair 14 into any of a corresponding plurality of radial positions with respect to bearing assembly 340. Recess 360 could be constructed in a variety of ways, for example, the recess could be tapered or threaded, etc. to accept shaft 382 of chair support means 380 (which has been correspondingly tapered or threaded, etc.).

Pulley 350 of bearing assembly 340, like above-described bearing assembly 172, has a circumferential contact cover or ring 368, and a pair of cables 364, 366 leading to trolling motor 12. Pulley 350 rotates freely against bearings 370 bearing assembly 340 includes. Two disk contacts 372, 374 are normally spaced apart; however, when the outer portion of cover 348 (or contact cover 368) is pressed downwards, contacts 372, 374 close to complete an electrical circuit connected to trolling motor 12, thereby activating the trolling motor. If desired, the circuit may be configured to remain closed, notwithstanding the release of contact cover 368 until contacts 372, 374 are brought together again. In this embodiment, disk contacts 372, 374 are fastened to bearing assembly 340; thus, the contacts do not rotate.

Contact cover 368 serves several purposes. First, cover 368 floats on the uppermost contact of contacts 372, 374;

second, cover 368 is used to activate trolling motor 12 as described above; and third, it serves to protect the contacts from water.

Figure 29B:
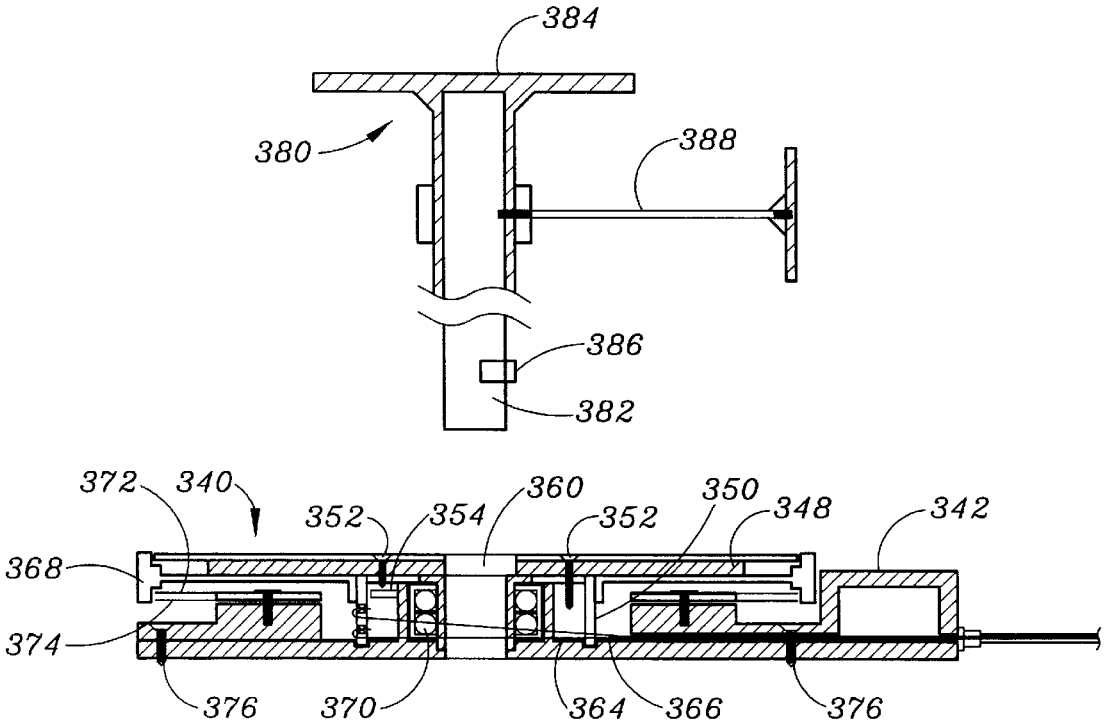

Bearing assembly 340 is approximately flat as shown in FIG. 29*b*, and attached to boat 10 with screws or other suitable means 376. Bearing assembly 340 is also configured to receive a chair support means 380 having a shaft 382, a chair base 384, and (if assembly 340 includes a groove 362) a key 386. The radial position of a chair (not shown) attached to base 384 may be adjusted via a set screw 388.

If desired, any of the above-described bearing assemblies may include an orientation indicator that shows the angle of trolling motor 12 and therefore, the direction of travel of boat 10. For example, an indicator 390 may be attached in any convenient fixed location, for example, to panel 342 (FIG. 29*a*). Indicator 390 is in operational connection with bearing assembly 340 to enable the user to visualize the angle of trolling motor 12. Indicator 390 may, of course, be placed elsewhere on boat 10 if preferred.

Figure 30A:
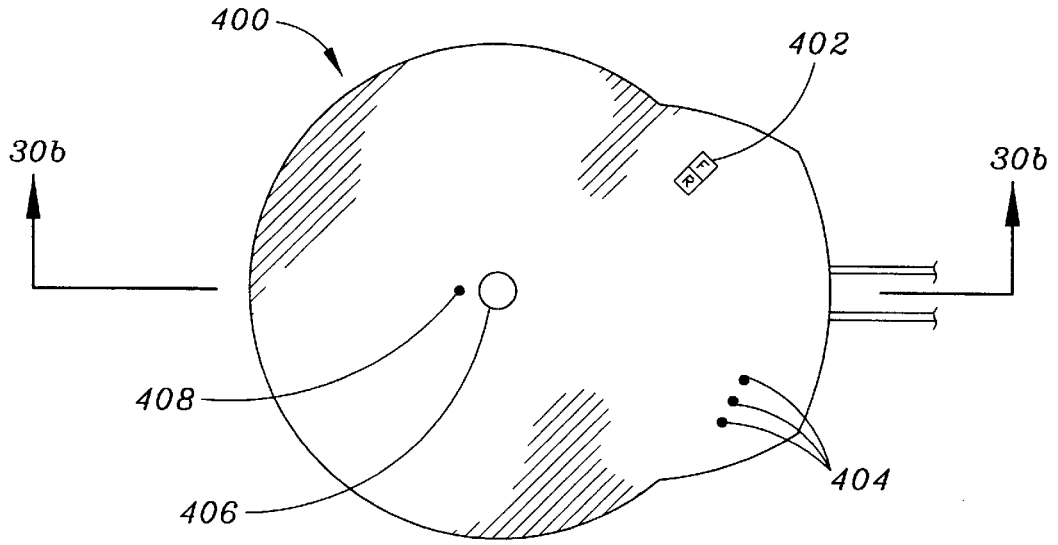
FIGS. 30*a* and 30*b* illustrate a bearing assembly according to yet another preferred embodiment of the present invention.
Figure 30B:
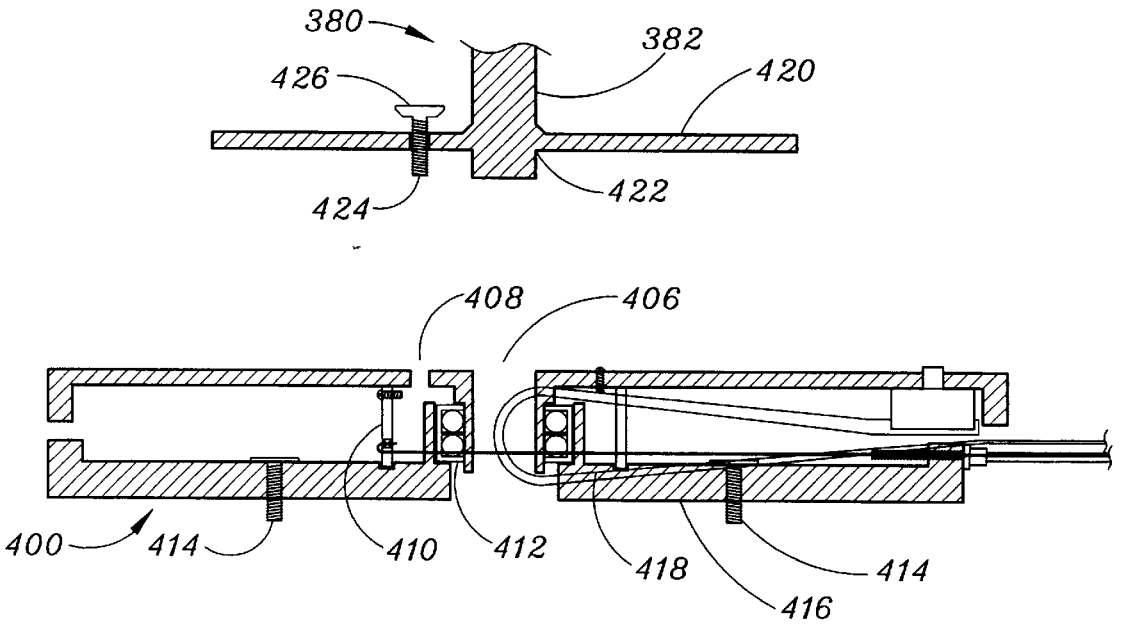

Referring now to FIGS. 30*a* and 30*b*, there are shown top and side cross-sectional views, respectively, of a bearing assembly 400 according to still another preferred embodiment of the present invention. Bearing assembly 400 includes a forward/reverse switch 402, a plurality of speed control switches 404 (one for each speed of trolling motor 12), a central hole 406 for receiving the shaft of a chair assembly, and a threaded hole 408. Switches 402 and 404 rotate with bearing assembly 400. A pulley 410 rotates on bearings 412, substantially as described above. Bearing assembly 400, like above-described bearing assembly 340, is configured to lie approximately flat against the bottom of boat 10, and may be attached to the boat by screws or bolts 414. However, bearing assembly 400 need not be attached to boat 10.

Bearing assembly 400 is configured to receive a chair support means such as support means 380, having a shaft 382 with a base 420 at one end and a chair base 384 (as shown in FIG. 29*b*) at the other end. Base 420 has a hole 424 which is aligned with a threaded hole 408 in bearing assembly 400 when end 422 is inserted into recess 406. Then, support means 380 is secured in position by a screw 426.

Figure 31A:
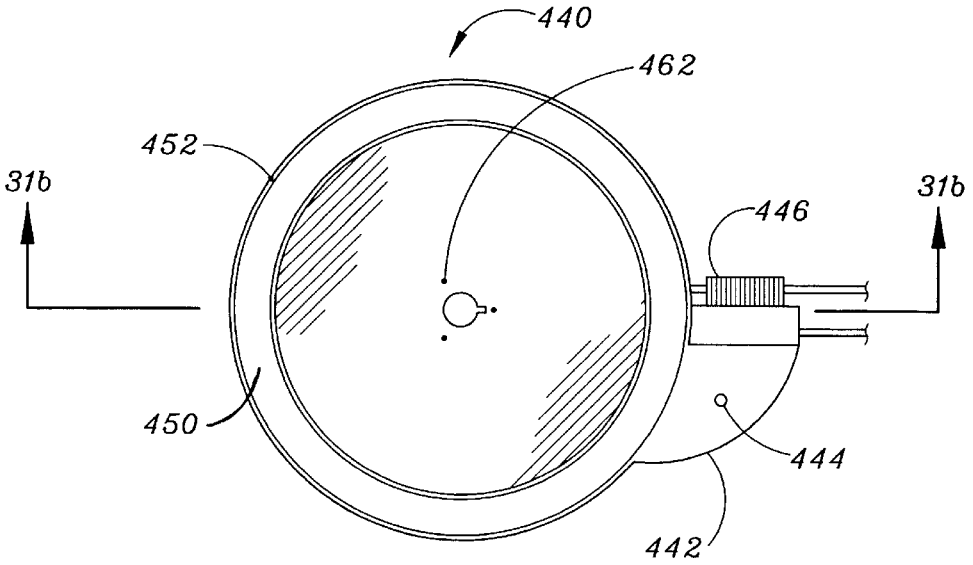
FIGS. 31*a* and 31*b* are top and side (taken along lines 31*b*—31*b* of FIG. 31*a*) views, respectively of a bearing assembly according to another preferred embodiment of the present invention.
Figure 31B:
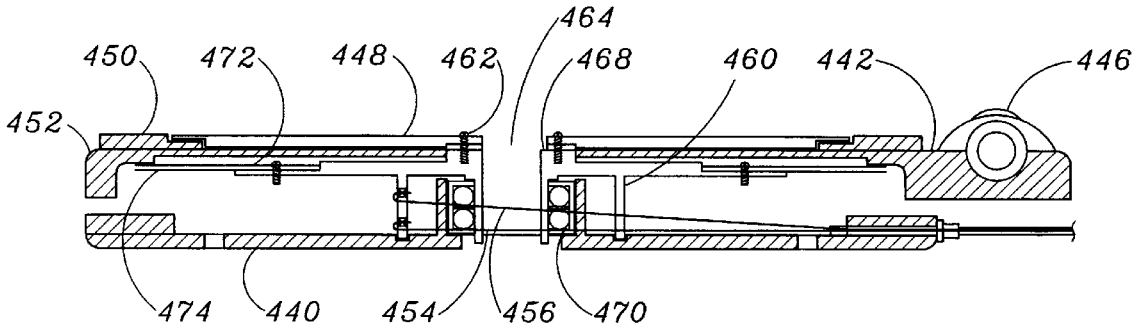

FIGS. 31*a* and 31*b* show another preferred embodiment of the present invention. A bearing assembly 440 includes a foot control panel 442 with a switch 444 (a "push-for-on, push-for-off" switch) and a rotatable, variable-speed control switch 446. If desired, panel 442 could include a forward/reverse switch (not shown). A cover 448 is attached to a pulley 460 by screws 462. A recess 464, which may include a groove 468, is dimensioned for receiving the shaft of a chair such as above-described chair 14. Pulley 460 rotates freely against bearings 470; a pair of cables 454, 456 lead to trolling motor 12. Two disk contacts 472, 474 are normally spaced apart; however, when the outer portion of cover 448 (or a disk 450 that floats on a disk cover 452) is pressed downwards about cover 452, the contacts close to complete an electrical circuit connected to trolling motor 12, thereby activating the trolling motor. In this embodiment of the invention, contacts 472, 474 are fastened to pulley 460 and turn with bearing assembly 440. Panel 442 is preferably integrally formed with disk cover 452, and normally turns with bearing assembly 440. However, the radial position of panel 442 may be adjusted with respect to the position of a chair attached to bearing assembly 440 if desired.

Figure 32:
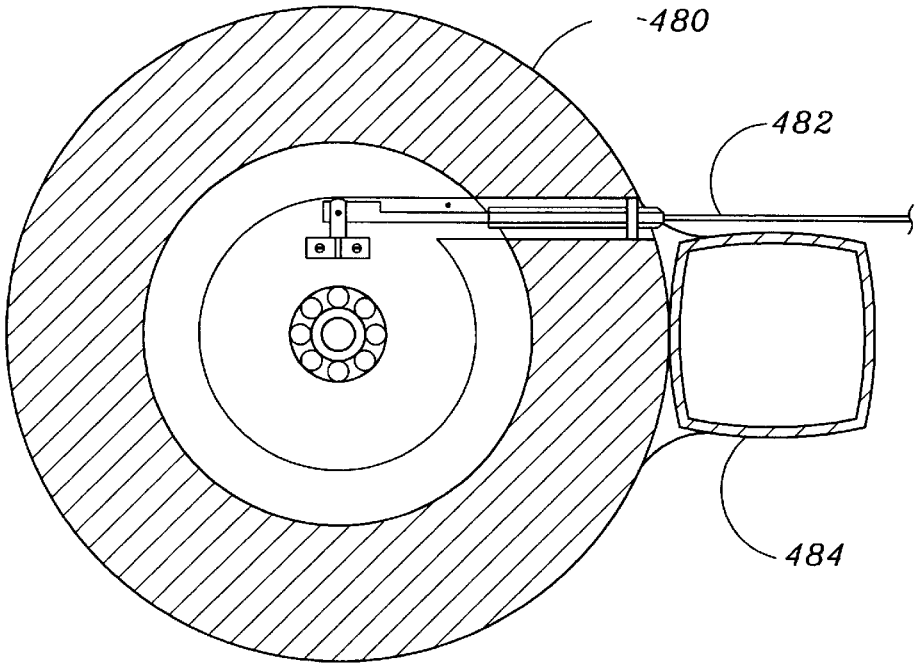
FIG. 32 is a top view of a bearing assembly connected to the trolling motor by a single cable.

As noted above, a bearing assembly according to the present invention may be connected to trolling motor 12 by one, two, or more cables. FIG. 32 shows a top, schematic view of a bearing assembly 480 connected to motor 12 by a single cable 482. Bearing assembly 480 may include a foot control 484 with forward/reverse and speed control switch as described above.

Figure 33A:
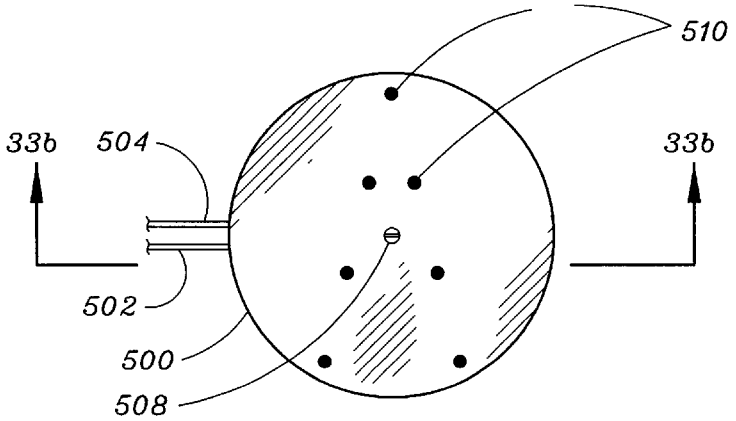
FIGS. 33*a*, 33*b*, and 33*c* show a first shaft of a trolling motor and an orientation means according to a preferred embodiment of the present invention.
Figure 33B:
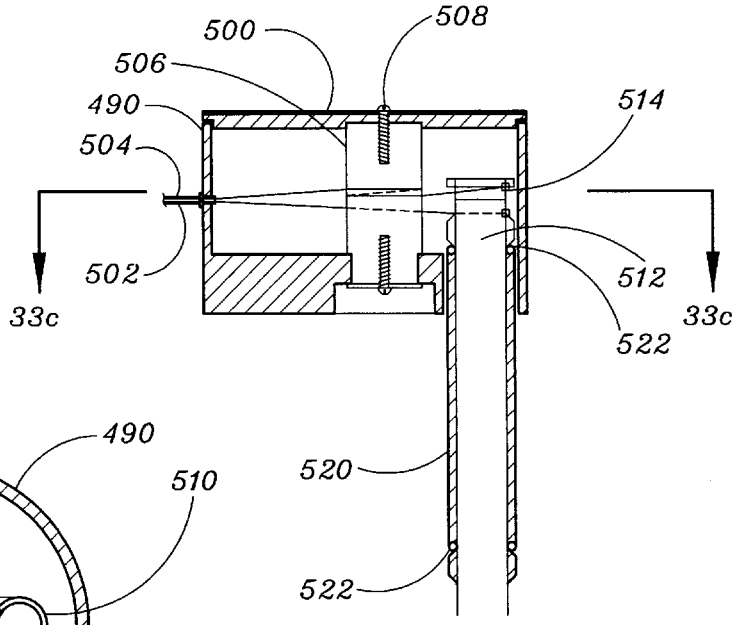
Figure 33C:
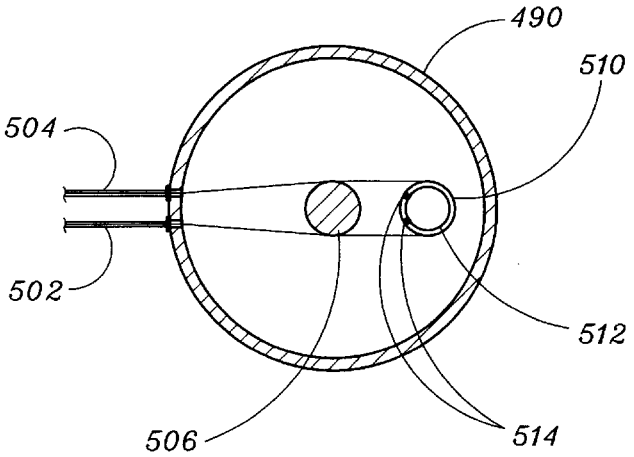

FIGS. 33*a*, 33*b*, and 33*c* represent a first shaft with an orientation means according to a preferred embodiment of the present invention. Trolling motor 12 includes a housing 490, a top, removable cover 500 and a pair of cables 502, 504. Cover 500 is attached to a central shaft 506 by a screw 508. Cover 500 is rotatable and substantially waterproof, and carries a plurality of dots or other markers 510. Dots 510 are arranged to form a directional indicator that corresponds to the angle of trolling motor 12, and therefore indicates the direction of travel of boat 10 as cover 500 rotates on a bearing surface of housing 490.

Cables 502, 504 are attached to an inner shaft 512 by a fastening means 514, and are connected to shaft 506 as indicated in FIG. 33*c*; trolling motor 12 is attached to the other end of shaft 512. One of cables 502, 504 is wrapped around shaft 506; thus, shafts 506 and 512 rotate together. An outer shaft 520 is rotatable with respect to inner shaft 512 on bearings 522.

Figure 34:
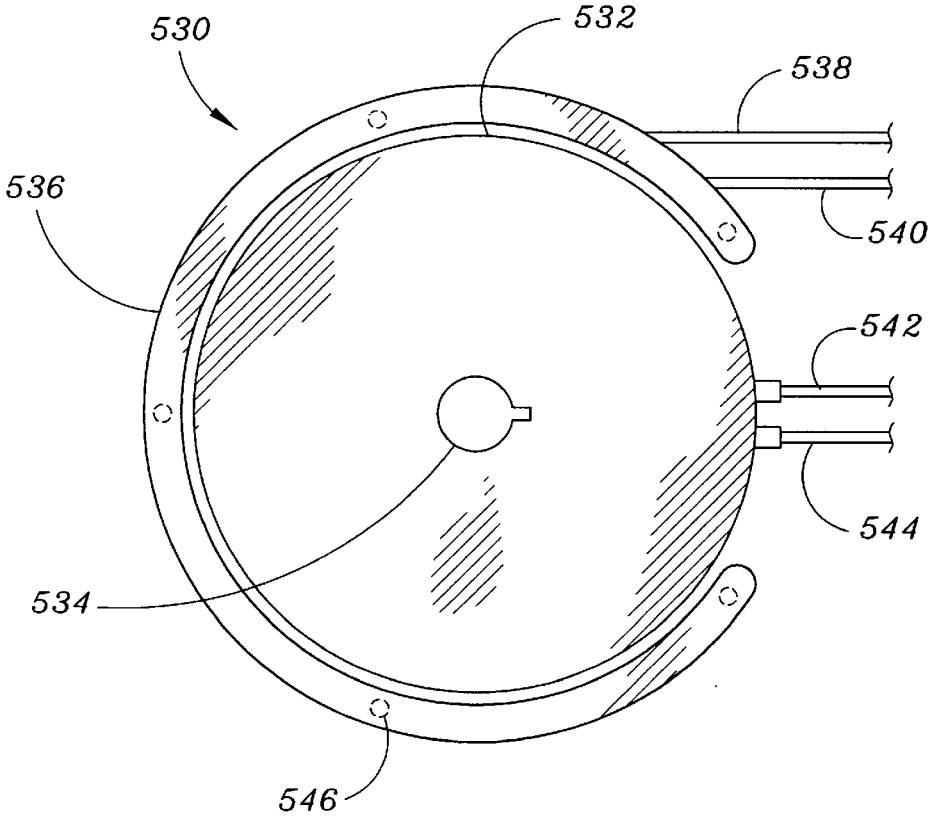
FIG. 34 is a top view of still another preferred embodiment of the present invention.

FIG. 34 illustrates a top view of an apparatus 530 according to still another preferred embodiment of the present invention, wherein a bearing assembly 532 with a central recess 534 for receiving an optional chair support means as shown in FIG. 29-B part #382. Activation means 536 is carried by boat 10 and is positioned near bearing assembly 532. Cables 538, 540 electrically connect activation means 536 to trolling motor 12; steering cables 542, 544 lead from bearing assembly 532 to the shaft of the trolling motor. Activation means 536 includes a plurality of switches 546 electrically connected to trolling motor 12 via cables 538, 540 alternately control assembly 532 and activation means 536 could have means (other than cable) in operational connection with the trolling motor 12 for controlling the direction and speed the boat 10 travels.

It will be apparent to those skilled in the art that many changes and substitutions can be made to the preferred embodiments herein described without departing from the spirit and scope of the present invention as defined by the appended claims.

What is claimed is:

1. An apparatus for maneuvering a boat on water, said boat having a trolling motor with a first shaft, said first shaft having a first axis, said trolling motor rotatable about said first axis, said apparatus comprising:

a foot-operated bearing assembly having a second shaft with a second axis, said bearing assembly rotatable about said second axis;

a chair;

means formed in said bearing assembly for securing said chair thereto;

means for activating said trolling motor, said activating means operably connected to said chair; and means in operational connection with said bearing assembly for transferring rotational motion of said second shaft to said first shaft of said trolling motor so that when said second shaft rotates, said trolling motor rotates.

2. The apparatus as recited in claim 1, wherein said transferring means at least partially encircles said bearing assembly, said transferring means being in electrical connection with said trolling motor.

3. The apparatus as recited in claim 1, wherein said activating means is in operational connection with said bearing assembly.

4. The apparatus as recited in claim 1, wherein said activating means is carried by said bearing assembly.

5. The apparatus as recited in claim 1, wherein said activating means is carried by said boat and positioned near said bearing assembly.

6. The apparatus as recited in claim 1, wherein said activating means is rotatable.

7. The apparatus as recited in claim 1, wherein said activating means is carried by said bearing assembly so that said activating means rotates independently of said bearing assembly about said second axis.

8. The apparatus as recited in claim 1, wherein said activating means is positioned so that said activating means is operable by the foot of a user regardless of the orientation of said foot to said bearing assembly.

9. The apparatus as recited in claim 1, wherein said securing means further comprises chair support means in operational connection with said bearing assembly, said support means rotatable with said assembly so that, when a chair is secured to said support means, said chair is rotatable independently of said support means, said chair being attachable to said chair support means in any orientation of said chair to said chair support means so that said chair is rotatable with said chair support means.

10. The apparatus as recited in claim 1, further comprising means in operational connection with said bearing assembly for indicating an orientation of said boat.

11. The apparatus as recited in claim 1, further comprising a cover at least partially encircling said bearing assembly, said cover positioned above said activating means so that said cover rotates about said second shaft independently of said activating means.

12. The apparatus as recited in claim 1, wherein said chair is tiltable, said activating means being operable by tilting of said chair by a user.

13. The apparatus as recited in claim 1, further comprising:

a third shaft rotatable about a third axis;

means for indicating an orientation of said boat, said indicator means at least partially encircling said third shaft, said indicator means rotationally connected to said second shaft and said first shaft so that said indicator means, said first shaft and said second shaft rotate together about said third axis, said first axis, and said second axis, respectively.

14. The apparatus as recited in claim 1, wherein said activating means is placed to at least partially surround said bearing assembly, said activating means in electrical connection with said trolling motor for activating at least one speed of said trolling motor.

15. The apparatus as recited in claim 1, wherein said activating means is nonrotatable.

16. The apparatus as recited in claim 1, wherein said activating means at least partially encircles said bearing assembly, and wherein said activating means is accessible to the heel of a user's foot to activate a speed of a plurality of trolling motor speeds while actively steering said boat by rotating said chair while said user is seated in said chair.

17. An apparatus for maneuvering a boat on water, said boat having a trolling motor with a first shaft, said first shaft having a first axis, said trolling motor rotatable in a clockwise and a counterclockwise direction about said first axis, said apparatus comprising:

a bearing assembly having a second shaft with a second axis, said bearing assembly being formed for receiving a chair;

means formed in said bearing assembly for removably securing a chair thereto;

cable means in operational connection with said bearing assembly for transferring rotational motion of said second shaft to said first shaft of said trolling motor so that when said second shaft rotates, said trolling motor rotates; and trolling motor activating means carried by said bearing assembly so that, when a user is seated in a chair secured to said bearing assembly, said activating means is operable by the foot of said user to activate said trolling motor and said boat is steerable by rotating said chair.

18. The apparatus as recited in claim 17, wherein said activating means encircles said bearing assembly.

19. The apparatus as recited in claim 17, wherein said bearing assembly has means formed therein for securing a chair thereto, and wherein said apparatus further comprises trolling motor activating means carried by said chair and rotatable about said second shaft so that, when a user is seated in said chair, said activating means is operable to activate said trolling motor and said boat is steerable by rotating said chair.

20. The apparatus as recited in claim 17, wherein said transferring means is carried by said second shaft so that, when a tiltable chair is secured to said bearing assembly, tilting of said chair activates said trolling motor.

21. The apparatus as recited in claim 17, wherein said activating means encircles said bearing assembly, said activating means positioned so that said activating means is operable by the foot of a user regardless of the orientation of said foot to said bearing assembly.

22. The apparatus as recited in claim 17, wherein said activating means is carried by said bearing assembly so that, when a tiltable chair is attached to said bearing assembly, tilting of said chair activates said trolling motor.

23. The apparatus as recited in claim 17, wherein said cable means is substantially contained within a flexible housing.

24. The apparatus as recited in claim 17, further comprising a cover above said activating means, said cover encircling said bearing assembly.

25. The apparatus as recited in claim 17, further comprising:

a third shaft rotatable about a third axis;

means for indicating an orientation of said boat, said indicator means at least partially encircling said third shaft, said indicator means rotationally connected to said second shaft and said first shaft so that said indicator means, said first shaft and said second shaft rotate together about said third axis, said first axis, and said second axis, respectively.

26. The apparatus as recited in claim 17, wherein said activating means is placed in at least a partial circle around said bearing assembly.

27. The apparatus as recited in claim 17, wherein said activating means at least partially surrounds said bearing assembly, said activating means accessible to the foot of a user to activate at least one speed of a plurality of speeds of said trolling motor without needing to reposition or remove said foot while actively steering said boat.

28. The apparatus as recited in claim 17, wherein said activating means further comprises a substantially continuous band at least partially surrounding said bearing assembly.

29. An apparatus for controlling a trolling motor, said trolling motor installed on a boat so that said trolling motor is rotatable about a first axis, said apparatus comprising:

a bearing assembly having a second shaft with a second axis, said bearing assembly rotatable about said second axis;

means formed in said bearing assembly for receiving an optional chair support means, said chair support means being removable by a user;

cable means in operational connection with said bearing assembly and said trolling motor, said cable means transferring rotational motion of said second shaft to said trolling motor so that when said second shaft rotates about said second axis, said trolling motor rotates about said first axis; and means for activating said trolling motor, said activating means in electrical connection with said trolling motor so that, when a user is seated in a chair secured to said chair-receiving means, said activating means is operable by the foot of a user to activate said trolling motor and said boat is steerable by rotating said chair.

30. The apparatus as recited in claim 29, wherein, said transferring means further comprises means for rotating said second shaft to cause rotation of said trolling motor.

31. The apparatus as recited in claim 29, wherein said transferring means is positioned for operation by the foot of a user.

32. The apparatus as recited in claim 29, wherein said transferring means is positioned for operation by the foot of a user regardless of the orientation of said foot to said bearing assembly.

33. The apparatus as recited in claim 29, wherein said transferring means encircles said bearing assembly so that said activating means is rotatable about said second axis, said activation means in electrical connection with said trolling motor so that said activating means is operable by the foot of a user to control said trolling motor.

34. The apparatus as recited in claim 29, further comprising means in operational connection with said bearing assembly for indicating an orientation of said boat.

35. The apparatus as recited in claim 29, wherein said trolling motor includes a first shaft rotatable about said first axis, and wherein said cable means further comprises at least one cable leading from said first shaft to said second shaft.

36. The apparatus as recited in claim 29, wherein said cable means is substantially contained within a flexible housing.

37. The apparatus as recited in claim 29, further comprising a cover above said activating means, said cover encircling said bearing assembly.

38. The apparatus as recited in claim 29, further comprising:

a first shaft rotatable about said first axis, said first shaft connected to said trolling motor; and means carried by said first shaft for fastening said cable means thereto so that said first shaft and said second shaft rotate together about said first and said second axes, respectively.

39. The apparatus as recited in claim 29, further comprising:

a third shaft rotatable about a third axis;

means for indicating an orientation of said boat, said indicator means at least partially encircling said third shaft, said indicator means rotationally connected to said second shaft and said first shaft so that said indicator means, said first shaft and said second shaft rotate together about said third axis, said first axis, and said second axis, respectively.

40. The apparatus as recited in claim 27, wherein said bearing assembly has means formed therein for securing a chair thereto, and wherein said activating means is carried by said chair and rotatable about said second shaft so that, when a user is seated in said chair, said activating means is operable to activate said trolling motor and said boat is steerable by rotating said chair.

41. The apparatus as recited in claim 29, wherein said cable means is substantially contained within a flexible housing.

42. The apparatus as recited in claim 29, wherein said cable means further comprises at least one cable leading from said second shaft to said first shaft.

43. The apparatus as recited in claim 29, wherein said activating means is placed to at least partially surround said bearing assembly, said activating means in operational connection with said trolling motor for activating at least one speed of said trolling motor.

44. The apparatus as recited in claim 29, further comprising chair support means releasably attached to said receiving means.

45. The apparatus as recited in claim 29, further comprising:

chair support means releasably attached to said receiving means; and a tiltable chair secured to said chair support means, said activating means being operable by tilting of said chair by a user.

46. The apparatus as recited in claim 29, wherein said activating means is placed in a partial circle around said bearing assembly, said activating means operable by the foot of said user to control more than one forward speed of said trolling motor without needing to reposition or remove said foot from said bearing assembly while actively steering said boat with said foot, said activating means accessible to the toes or heel of said foot.

47. An apparatus for maneuvering a boat on water, said boat having a trolling motor with a first axis, said trolling motor rotatable about said first as in a clockwise and a counterclockwise direction, said apparatus comprising:

a trolling motor control assembly, said control assembly including chair support means;

transferring means carried by said control assembly, said transferring means in operational connection with said trolling motor for transferring rotational motion of said control assembly to said trolling motor so that, when said control assembly rotates about a second axis, said trolling motor rotates about said first axis; and trolling motor activating means in operations connection with said trolling motor for activating at least one speed of said trolling motor, said activating means placed in a position at least partially surrounding said control assembly so that, when a user is seated in a chair attached to said chair support means, said activating means is accessible to a foot of said user to activate said trolling motor and said boat is steerable by rotating said chair.

48. The apparatus as recited in claim 47, wherein said control assembly includes a bearing assembly.

49. The apparatus as recited in claim 47, wherein said activating means is placed to encircle said control assembly.

50. The apparatus as recited in claim 47, wherein said activating means is placed to at least partially surround said control assembly, said activating means being rotatable about said control assembly.

51. The apparatus as recited in claim 47, wherein said activating means at least partially surrounds said control assembly so that a user can access more than one forward speed of said trolling motor with his foot while seated in said chair and actively steering said boat without needing to reposition his foot or remove said foot from said activation means.

52. The apparatus as recited in claim 47, wherein said activating means further comprises a substantially continuous band at least partially surrounding said control assembly.

53. The apparatus as recited in claim 47, wherein said activating means is in operational connection with said control assembly, said activating means being positioned to be accessible to the foot of a user while said user is seated in a chair attached to said chair support means regardless of an orientation of said chair to said control assembly.

54. The apparatus as recited in claim 47, wherein said activating means is carried by said control assembly and rotatable therewith about said second axis.

55. The apparatus as recited in claim 47, wherein said activating means is carried by said control assembly so that said activating means does not rotate with sand control assembly about said second axis.

56. An apparatus for maneuvering a boat on water, said boat having a trolling motor with a first axis, said trolling motor rotatable about said first axis in a clockwise and a counterclockwise direction, said apparatus comprising:

a control assembly formed for receiving a chair;

means in operation connection with said control assembly for transferring rotational motion of said control assembly to said trolling motor so that when said control assembly rotates, said trolling motor rotates; and trolling motor activating means in operational connection with said control assembly, for activating at least one speed of said trolling motor, said activating means at least partially surrounding said control assembly.

57. The apparatus as recited in claim 56, wherein said control assembly includes a bearing assembly.

58. The apparatus as recited in claim 56, wherein said activating means further comprises a substantially continuous band at least partially surrounding said control assembly.

59. The apparatus as recited in claim 56, wherein said activating means is operable by the foot of a user to activate at least a speed of said trolling motor.

60. The apparatus as recited in claim 56, wherein said boat is steerable by rotating said control assembly with the foot of a user.

61. The apparatus as recited in claim 56, wherein said activating means is carried by said control assembly so that, when a user is seated in a chair secured to said control assembly, said activating means is operable by the foot of said user and said boat is steerable by rotating said chair.

62. The apparatus as recited in claim 56, wherein said activating is placed to surround said control assembly, said activating means being accessible to the foot of a user to activate a plurality of trolling motor speeds without to reposition said foot on or remove said foot from said control assembly while actively steering said boat.

63. The apparatus as recited in claim 56, wherein said activating means is placed in at least a partial circle around said control assembly.

64. The apparatus as recited in claim 56, wherein said activating means is rotatable about said control assembly.

65. The apparatus as recited in claim 56, wherein said activating means does not rotate about said control assembly.

66. The apparatus as recited in claim 56, further comprising trolling motor orientation means in operation connection with said control assembly.

67. The apparatus as recited in claim 56, further comprising trolling motor speed indicator means in operational connection with said control assembly.

68. The apparatus as recited in claim 56, wherein said activating means is carried by said control assembly so that, when a tiltable chair is secured to said control assembly, tilting of said chair activates said trolling motor.

69. The apparatus as recited in claim 56, wherein said activating means is placed in a circle around said control assembly, said activating means positioned so that said activating means is operable by the foot of a user regardless of the orientation of said foot to said control assembly.

70. An apparatus for maneuvering a boat on water, said bat having a trolling motor with a first axis, said trolling motor rotatable about said first axis in a clockwise and a counterclockwise direction, said apparatus comprising:

a foot-operable trolling motor control assembly, said control assembly having a plate rotatable about a second axis in an approximately horizontal plane;

trolling motor activating means in operational connection with said control assembly and said trolling motor for activating at least one speed of said trolling motor;

transferring means in operational connection with said plate and said trolling motor so that, when said plate rotates about said second axis, said trolling motor rotates about said first axis, wherein said transferring means further comprises a first cable for pulling said trolling motor in said clockwise direction and a second cable for pulling said trolling motor in said counterclockwise direction and a bearing assembly connected to said plate, said bearing assembly having:

a second shaft rotatable about a second axis; and a pulley in operational connection with said plate, said pulley rotatable about said second axis said pulley being connected to said first and said second cables and said trolling motor so that when said pulley rotates about said second axis, said trolling motor rotates about said first axis.

71. The apparatus as recited in claim 70, wherein said activating means is positioned on said plate for activating a plurality of forward speeds of said trolling motor, said activating means operable by the foot of a user while said foot is positioned on said plate and actively steering said boat without needing to reposition said foot or lift said foot from said plate.

72. The apparatus as recited in claim 70, wherein said trolling motor activation means is positioned on said plate for activating at least one forward speed and at least one reverse speed of said trolling motor, said activating means operable by the foot of a user while said foot is positioned on said plate and actively steering said boat without needing to reposition said foot or lift said foot from said plate.

73. The apparatus as recited in claim 70, wherein said activating means is placed to at least partially surround said control assembly.

74. The apparatus as recited in claim 70, wherein said activating means is placed to at least partially surround said control assembly, said activating means being rotatable around said control assembly.

75. The apparatus as recited in claim 70, wherein said activating means further comprises a substantially continuous band at least partially surrounding said control assembly.

76. The apparatus as recited in claim 70, wherein said control assembly is formed for receiving a chair.

77. The apparatus as recited in claim 70, further comprising speed controlling means in operational connection with said control assembly, wherein an orientation of said controlling means can be repositioned to any orientation of said speed controlling means to said control assembly.

78. An apparatus for maneuvering a boat on water, said boat having a trolling motor with a first axis, said trolling motor rotatable about said first axis in a clockwise and a counterclockwise direction, said apparatus comprising:

a foot-operated trolling motor control assembly, said control assembly having a control plate rotatable about a second axis; and trolling motor activating means positioned on said control plate, said activating means in operational connection with said trolling motor for activating a plurality of speeds of said trolling motor, said activating means operable by the foot of a user while said foot is positioned on said control plate and actively steering said boat without needing to reposition said foot or lift said foot from said control plate; and transferring means in operational connection with said control plate and said trolling motor so that, when said control plate rotates about said second axis, said trolling motor rotates about said first axis.

79. The apparatus as recited in claim 78, wherein said activation means further comprises speed control means for activating all desired speeds of said trolling motor, said speeds being activated by the toe portion of the foot of a user by pressing lightly for a first speed, pressing increasingly harder for obtaining all desired speeds of said trolling motor while actively steering said boat without having to reposition said foot or remove said foot from said control plate.

80. The apparatus as recited in claim 78, wherein said activating means further comprises a plurality of trolling motor activating switches placed on said control plate.

81. The apparatus as recited in claim 78, wherein said activating means is positioned on said control plate for activating a plurality of forward speeds of said trolling motor, said activating means operable by the foot of a user while said foot is positioned on said control plate and actively steering said boat without needing to reposition said foot or lift said foot from said control plate.

82. The apparatus as recited in claim 78, wherein said trolling motor activation means is positioned on said control plate for activating at least one forward speed and at least one reverse speed of said trolling motor, said activating means operable by the foot of a user while said foot is positioned on said control plate end actively steering said boat without needing to reposition said foot or lift said foot from said control plate.

83. The apparatus as recited in claim 78, wherein said transferring means further comprises a first cable for pulling said trolling motor in said clockwise direction and a second cable for pulling said trolling motor in said counterclockwise direction.

84. The apparatus as recited in claim 78, further comprising a bearing assembly connected to said control plate, said bearing assembly having:

a second shaft rotatable about a second axis; and a pulley in operational connection with said control plate, said pulley rotatable about said second axis, said pulley being connected to said first and said second cables and said first shaft so that when said pulley rotates about said second axis, said trolling motor rotates about said first axis.

85. The apparatus as recited in claim 78, wherein said control assembly is formed for receiving a chair.

86. The apparatus as recited in claim 78, wherein said activating means includes speed controlling means positioned on said control plate, and wherein the orientation of said control means can be repositioned to any orientation of said speed controlling means to said control assembly.

87. The apparatus as recited in claim 78, wherein said activation means at least partially surrounds said control assembly.

88. The apparatus as recited in claim 78, wherein said activation means contains a substantially continuous band at least partially surrounding said control assembly.

89. An apparatus for maneuvering a boat on water, said boat having a trolling motor with a first axis, said trolling motor rotatable about said first axis in a clockwise and a counterclockwise direction, said apparatus comprising:

a foot-operable control assembly for controlling rotation of said trolling motor about said first axis;

a speed control assembly for activating at least one speed of said trolling motor, said speed control assembly placed to at least partially surround said control assembly; and means for operationally connecting said speed control assembly to said trolling motor.

90. The apparatus as recited in claim 89, wherein said trolling motor has a plurality of speeds, and wherein said speed control assembly is configured for activating of a selected speed of said plurality of speeds with the foot of a user without having to reposition said foot on said speed control assembly.

91. The apparatus as recited in claim 89, and wherein said speed control assembly includes a substantially continuous band for activating at least a speed of said trolling motor, said band at least partially surrounding said control assembly.

92. The apparatus as recited in claim 89, wherein said speed control assembly is rotatable.

93. The apparatus as recited in claim 89, wherein said speed control assembly does not rotate.

94. The apparatus as recited in claim 89, wherein said activation means is rotatable.

95. The apparatus as recited in claim 89, wherein said activation means does not rotate.

96. The apparatus as recited in claim 89, wherein said control assembly further comprises a foot-operable rotatable plate, said rotatable plate in operational connection with said trolling motor for rotating said trolling motor about said first axis.

97. The apparatus as recited in claim 89, wherein said control assembly further comprises:

a foot-operated bearing assembly having a second shaft with a second axis, said bearing assembly rotatable about said second axis; and means in operational connection with said bearing assembly for transferring motion of said second shaft to said first shaft of said trolling motor so that when said second shaft rotates, said trolling motor rotates.

98. The apparatus as recited in claim 89, wherein said control assembly is formed to receive a chair.

99. The apparatus as recited in claim 89, further comprising means in operational connection with said control assembly and said trolling motor for controlling the rotational motion of said trolling motor about said first axis.

* * * * *